US005565310A

United States Patent [19]

Kawai

[11] Patent Number: 5,565,310

[45] Date of Patent: Oct. 15, 1996

[54] SILVER HALIDE COLOR LIGHT-SENSITIVE MATERIAL

[75] Inventor: Kiyoshi Kawai, Kanagawa, Japan

[73] Assignee: Fuji Photo Film Co., Ltd., Kanagawa, Japan

[21] Appl. No.: 378,007

[22] Filed: Jan. 25, 1995

[30] Foreign Application Priority Data

Jan. 27, 1994 [JP] Japan ..... 6-023528

[51] Int. Cl.[6] ..... G03C 1/46

[52] U.S. Cl. ..... 430/503; 430/517; 430/522; 430/558

[58] Field of Search ..... 430/558, 517, 430/522, 503, 567, 538

[56] References Cited

U.S. PATENT DOCUMENTS 4,558,002 12/1985 Aotsuka et al. ..... 430/538

FOREIGN PATENT DOCUMENTS 2337490 10/1989 European Pat. Off. .
0571959 12/1993 European Pat. Off. .
3156452 11/1989 Japan .
2-296241 12/1990 Japan .

*Primary Examiner*—Geraldine Letscher
*Attorney, Agent, or Firm*—Sughrue, Mion, Zinn, Macpeak & Seas

[57] ABSTRACT

A silver halide color light-sensitive material comprising a reflective support having provided thereon a yellow-forming light-sensitive layer, a magenta-forming light-sensitive layer, and a cyan-forming light-sensitive layer, wherein said magenta-forming layer contains a pyrazolo[1,5-b][1,2,4] triazole magenta coupler having a substituted phenyl at the 2-position and a bulky substituent at the 6-position, and said light-sensitive material has a reflection density of not less than 0.3. The light-sensitive material has excellent sharpness and reduced dependence on processing.

13 Claims, No Drawings

SILVER HALIDE COLOR LIGHT-SENSITIVE MATERIAL

FIELD OF THE INVENTION

This invention relates to a silver halide color light-sensitive material and more particularly to a silver halide color light-sensitive material which can be processed rapidly, provides a sharp image, and has reduced dependence on processing.

BACKGROUND OF THE INVENTION

In recent years, various electronic means for image formation have been developed and compared with silver halide photographic materials in image quality. It follows that the high image quality and handiness of the latter have been appreciated anew and use of a silver halide color light-sensitive material as not only a printing material for photography but a hard copy material of an electron image has now been studied. Under such a situation, intensive studies have been conducted to accentuate the merits of silver halide light-sensitive materials by, for example, further improving image quality in sharpness or color reproducibility and making the processing simpler and more rapid. As for simpleness and rapidness of processing, the advancement of a simple and rapid development system represented by a mini-laboratory system has made it possible to provide prints of extremely high image quality in a shorter time at a less cost with relative ease. Further, use of a silver halide emulsion having a high silver chloride content (hereinafter referred to as a high silver chloride emulsion) has contributed to a great reduction in processing time and an improvement on processing dependence of image quality.

Known means for improving sharpness of a silver halide light-sensitive material having a reflective support include (1) anti-irradiation by using a water-soluble dye, (2) anti-halation by using colloidal silver, a mordant dye, dye solid fine particles, etc., (3) prevention of light piping toward a support by increasing the content of a white pigment in the resin layer laminated on a paper support or by coating a support with a gelatin dispersion of a white pigment.

Means (1) and (2) not only give rise to color remaining after processing especially in the case of rapid processing but adversely affect light-sensitive layers during storage. As for means (3), U.S. Pat. No. 4,558,002 teaches that sharpness can greatly be improved by coating a support with a gelatin dispersion of a white pigment, and JP-A-3-156452 (the term "JP-A" as used herein means an "unexamined published Japanese patent application") suggests great improvement in sharpness by increasing the white pigment content in the laminating polyolefin on a support. However, a white pigment-containing gelatin coat is not practically useful because it deteriorates preservability of a light-sensitive material, and the resultant increase in film thickness brings such problems as increased dependence of image quality on processing, loss of suitability to rapid processing due to retardation of drying, and increase in cost. The increased white pigment content in the polyolefin layer also results in an increase in cost.

Therefore, means (1), i.e., use of a water-soluble dye, is generally adopted to improve sharpness for its economical advantage and relatively small adverse influence. Water-soluble dyes described in EP-A2-337490, pp. 27–76 are generally employed. Among them, oxonol dyes and cyanine dyes are used the most for their relatively small color remaining after processing. Even with these dyes, however, color remaining after processing becomes noticeable with the increasing amount added particularly in a processing system using a reduced processing time, so that it has been impossible to use them in a sufficient amount for assuring satisfactory sharpness.

In addition, if the oxonol dye is used in an increased amount so that the light-sensitive material may have a reflection density of not less than 0.3 at 550 nm, an appreciable amount of the dye will be dissolved into a processing solution and accumulated therein. It follows that the accumulated dye in the processing solution adversely affects the development of a light-sensitive material in continuous processing especially causing a great reduction in magenta density.

It turned out that the above problem is conspicuous with a color light-sensitive material containing a high silver chloride emulsion and in a rapid processing system, and is more conspicuous when a light-sensitive material is exposed at a high illumination for a short time using such a light source as a laser.

SUMMARY OF THE INVENTION

An object of the present invention is to provide a silver halide color light-sensitive material containing high silver chloride emulsions qualified to form a high quality color image economically and rapidly, which is excellent in sharpness and free from color remaining after processing and hardly undergoes reduction, in magenta density due to an accumulated dye in a processing solution.

Another object of the present invention is to provide a method for forming a high quality color image rapidly by using the above-described silver halide color light-sensitive material.

The above objects of the present invention are accomplished by a silver halide color light-sensitive material containing a specific magenta coupler and color image formation using the same.

The present invention provides a silver halide color light-sensitive material comprising a reflective support having provided thereon at least three silver halide emulsion layers having different color sensitivity containing a yellow coupler, a magenta coupler or a cyan coupler, respectively, wherein the magenta coupler-containing silver halide emulsion layer contains at least one compound represented by formula (M-I), the light-sensitive material having a reflection density of not less than 0.3 at 550 nm.

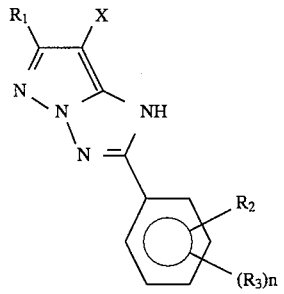

(M-I)

wherein $R_1$ represents a group represented by formula (Q-1):

$$-C(R_4)(R_5)-R_6 \quad \text{(Q-1)}$$

wherein $R_4$ represents an alkyl group or an aryl group; and $R_5$ and $R_6$ each represent a substituent; or $R_4$, $R_5$ and $R_6$ are taken together to form a 5- to 7-membered monocyclic or condensed ring;

a group represented by #0formula (Q-2):

$$—CH(R_7)—R_8 \quad (Q\text{-}2)$$

wherein $R_7$ represents a secondary or tertiary alkyl group, a cycloalkyl group, an aryl group or a heterocyclic group; $R_8$ represents an alkyl group, a cycloalkyl group, an aryl group or a heterocyclic group; or $R_7$ and $R_8$ are taken together to form a 5- to 7-membered ring;

or a group represented by formula (Q-3):

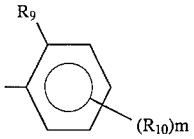

(Q-3)

wherein $R_9$ and $R_{10}$ each represent a substituent; and m represents 0 or an integer of 1 to 4; when m is 2 or greater, the plural $R_{10}$ groups may be the same or different;

$R_2$ and $R_3$ each represent a substituent; n represents 0 or an integer of 1 to 4; when n is 2 or greater, the plural $R_3$ groups may be the same or different; and X represents a hydrogen atom or a group releasable on coupling reaction with an oxidation product of a developing agent.

The present invention also provides a method for forming a color image comprising exposing the above-mentioned silver halide color light-sensitive material in a scanning exposure system for not more than $10^{-4}$ second per pixel and then subjecting the exposed material to color development processing.

DETAILED DESCRIPTION OF THE INVENTION

The pyrazolotriazole magenta coupler represented by formula (M-I) will be described in detail.

$R_2$ represents an alkyl group (preferably a straight-chain or branched alkyl group having 1 to 32 carbon atoms, e.g., methyl, ethyl, propyl, isopropyl, butyl, t-butyl, 1-octyl or tridecyl), a cycloalkyigroup (preferably a cycloalkyl group having 3 to 32 carbon atoms, e.g., cyclopropyl, cyclopentyl or cyclohexyl), an alkenyl group (preferably an alkenyl group having 2 to 32 carbon atoms, e.g., vinyl, allyl or 3-buten-1-yl), an aryl group (preferably an aryl group having 6 to 32 carbon atoms, e.g., phenyl, 1-naphthyl or 2-naphthyl), a heterocyclic group (preferably a 5- to 8-membered heterocyclic group having 1 to 32 carbon atoms, e.g., 2-thienyl, 4-pyridyl, 2-furyl, 2-pyrimidinyl, 1-pyridyl, 2-benzothiazolyl, 1-imidazolyl, 1-pyrazolyl or benzotriazol-2-yl), a cyano group, a halogen atom (e.g., fluorine, chlorine or bromine), a hydroxyl group, a nitro group, a carboxyl group, an alkoxy group (preferably an alkoxy group having 1 to 32 carbon atoms, e.g., methoxy, ethoxy, 1-butoxy, 2-butoxy, isopropoxy, t-butoxy or dodecyloxy), a cycloalkyloxy group (preferably a cycloalkyloxy group having 3 to 32 carbon atoms, e.g., cyclopentyloxy or cyclohexyloxy), an aryloxy group (preferably an aryloxy group having 6 to 32 carbon atoms, e.g., phenoxy or 2-naphthoxy), a heterocyclic oxy group (preferably a heterocyclic oxy group having 1 to 32 carbon atoms, e.g., 1-phenyltetrazol- 5-oxy, 2-tetrahydropyranyloxy or 2-furyloxy), a silyloxy group (prelerably a silyloxy group having 1 to 32 carbon atoms, e.g., trimethylsilyloxy, t-butyldimethylsilyloxy or diphenylmethylsilyloxy), an acyloxy group (preferably an acyloxy group having 2 to 32 carbon atoms, e.g., acetoxy, pivaloyloxy, benzoyloxy or dodecanoyloxy), an alkoxycarbonyloxy group (preferably an alkoxycarbonyloxy group having 2 to 32 carbon atoms, e.g., ethoxycarbonyloxy or t-butoxycarbonyloxy), a cycloalkyloxycarbonyloxy group (preferably a cycloalkyloxycarbonyloxy group having 4 to 32 carbon atoms, e.g., cyclohexyloxycarbonyloxy), an aryloxycarbonyloxy group (preferably an aryloxycarbonyloxy group having 7 to 32 carbon atoms, e.g., phenoxycarbonyloxy), a carbamoyloxy group (preferably a carbamoyloxy group having 1 to 32 carbon atoms, e.g., N,N-dimethylcarbamoyloxy or N-butylcarbamoyloxy), a sulfamoyloxy group (preferably a sulfamoyloxy group having 1 to 32 carbon atoms, e.g., N,N-diethylsulfamoyloxy or N-propylsulfamoyloxy), an alkanesulfonyloxy group (preferably an alkanesulfonyloxy group having 1 to 32 carbon atoms, e.g., methanesulfonyloxy or hexadecanesulfonyloxy), an arenesulfonyloxy group (preferably an arenesulfonyloxy group having 6 to 32 carbon atoms, e.g., benzenesulfonyloxy), an acyl group (preferably an acyl group having 1 to 32 carbon atoms, e.g., formyl, acetyl, pivaloyl, benzoyl or tetradecanoyl), an alkoxycarbonyl group (preferably an alkoxycarbonyl group having 2 to 32 carbon atoms, e.g., methoxycarbonyl, ethoxycarbonyl or octadecyloxycarbonyl), a cycloalkyloxycarbonyl group (preferably a cycloalkyloxycarbonyl group having 2 to 32 carbon atoms, e.g., cyclohexyloxycarbonyl), an aryloxycarbonyl group (preferably an aryloxycarbonyl group having 7 to 32 carbon atoms, e.g., phenoxycarbonyl), a carbamoyl group (preferably a carbamoyl group having 1 to 32 carbon atoms, e.g., carbamoyl, N,N-dibutylcarbamoyl, N-ethyl-N-octylcarbamoyl or N-propylcarbamoyl), an amino group (preferably an amino group having 32 or less carbon atoms, e.g., amino, methylamino, N,N-dioctylamino, tetradecylamino or octadecylamino), an anilino group (preferably an anilino group having 6 to 32 carbon atoms, e.g., anilino or N-methylanilino), a heterocyclic amino group (preferably a heterocyclic amino group having 1 to 32 carbon atoms, e.g., 4-pyridylamino), a carbonamido group (preferably a carbonamido group having 2 to 32 carbon atoms, e.g., acetamido, benzamido, tetradecanamido), a ureido group (preferably a ureido group having 1 to 32 carbon atoms, e.g., ureido, N,N-dimethylureido or N-phenylureido), an imido group (preferably an imido group having 10 or less carbon atoms, e.g., N-succinimido or N-phthalimido), an alkoxycarbonylamino group (preferably an alkoxycarbonylamino group having 2 to 32 carbon atoms, e.g., methoxycarbonylamino, ethoxycarbonylamino, t-butoxycarbonylamino or octadecyloxycarbonylamino), an aryloxycarbonylamino group (preferably an aryloxycarbonylamino group having 7 to 32 carbon atoms, e.g., phenoxycarbonylamino), a sulfonamido group (preferably a sulfonamido group having 1 to 32 carbon atoms, e.g., methanesulfonamido, butanesulfonamido, benzenesulfonamido or hexadecanesulfonamido), a sulfamoylamino group (preferably a sulfamoylamino group having 1 to 32 carbon atoms, e.g., N,N-dipropylsulfamoylamino or N-ethyl-N-dodecylsulfamoylamino), an azo group (preferably an azo group having 1 to 32 carbon atoms, e.g., phenylazo), an alkylthio group (preferably an alkylthio group having 1 to 32 carbon atoms, e.g., ethylthio or octylthio), an arylthio group (preferably an arylthio group having 6 to 32 carbon atoms, e.g., phenylthio), a heterocyclic thio group (preferably a heterocyclic thio group having 1 to 32 carbon atoms, e.g., 2-benzothiazolylthio, 2-pyridylthio or 1-phenyltetrazolylthio), an alkylsulfinyl group (preferably an alkylsulfinyl group having 1 to 32 carbon atoms, e.g., dodecanesulfinyl), an arenesulfinyl group (preferably an arenesulfinyl group having 6 to 32 carbon atoms, e.g., benzenesulfinyl), an alkanesulfonyl group (preferably an alkanesulfonyl group having 1 to 32 carbon atoms, e.g., methanesulfonyl or octanesulfonyl), an arenesulfonyl group (preferably an arenesulfonyl group having 6 to 32 carbon atoms, e.g., benzenesulfonyl or 1-naphthalenesulfonyl), a sulfamoyl group (preferably a sulfamoyl group having 32 or less carbon atoms, e.g., sulfamoyl, N,N-dipropylsulfamoyl or N-ethyl-N-dodecylsulfamoyl), a sulfo group, or a phosphonyl group (preferably a phosphonyl group having 1 to 32 carbon atoms, e.g., phenoxyphosphonyl, octyloxyphosphonyl or phenylphosphonyl).

$R_3$ has the same meaning as $R_2$.

In formula (Q-1), $R_4$ represents a straight or branched alkyl group having 1 to 32 carbon atoms or an aryl group having 6 to 32 carbon atoms. Specific examples of the alkyl and aryl groups as $R_4$ are the same as those mentioned for $R_2$. $R_5$ and $R_6$ each have the same meaning as $R_2$. Any two of $R_4$, $R_5$, and $R_6$ may be connected to each other to form a 5- to 7-membered monocyclic or condensed ring, which may be saturated or unsaturated and may be a carbon ring or a heterocyclic ring containing O, N, etc. as a hetero atom.

In formula (Q-2), $R_7$ represents a secondary or tertiary alkyl group, a cycloalkyl group having 3 to 32 carbon atoms, an aryl group having 6 to 32 carbon atoms, or a 5- to 8-membered heterocyclic group having 1 to 32 carbon atoms. The secondary or tertiary alkyl group as represented by $R_7$ is preferably represented by formula (Q-4):

$$-C(R_a)(R_b)-R_c \qquad \text{(Q-4)}$$

wherein $R_a$ represents a straight-chain or branched alkyl group having 1 to 32 carbon atoms; $R_b$ has the same meaning as $R_2$; and $R_c$ represents a hydrogen atom or has the same meaning as $R_2$.

Examples of the alkyl group as represented by $R_a$ and the cycloalkyl group, aryl group and heterocyclic group as represented by $R_7$ are the same as those described for $R_2$.

$R_8$ represents a straight-chain or branched alkyl group having 1 to 32 carbon atoms, a cycloalkyl group having 3 to 32 carbon atoms, an aryl group having 6 to 32 carbon atoms or a 5- to 8-membered heterocyclic group having 1 to 32 carbon atoms. Examples of the alkyl, cycloalkyl, aryl and heterocyclic groups as represented by $R_8$ are the same as those described for the alkyl, cycloalkyl, aryl and heterocyclic groups represented by $R_2$. $R_7$ and $R_8$ may be taken together to form a 5- to 7-membered ring. The description about the 5- to 7-membered ring formed in formula (Q-1) applies to the ring formed by $R_7$ and $R_8$.

In formula (Q-3), $R_9$ and $R_{10}$ each have the same meaning as $R_2$.

X represents a hydrogen atom or a group releasable on reacting with an oxidation product of a developing agent, such as a halogen atom, an alkoxy group, an aryloxy group, an acyloxy group, a carbamoyloxy group, a sulfonyloxy group, a carbonamido group, a sulfonamido group, a carbamoylamino group, a heterocyclic group, an arylazo group, an alkylthio group, an arylthio group, or a heterocyclic thio group. A preferred range and preferred examples of these groups are the same as those described for the corresponding groups represented by $R_2$. Additionally, X may be a his-type coupler residue bonded via an aldehyde group or a ketone group to form a dimer consisting of two molecules of a 4-equivalent coupler. X may also be a photographically useful group, such as a development accelerator, a development inhibitor, a desilvering accelerator or a leuco dye, or a precursor thereof.

The group as represented by $R_1$, $R_2$, $R_3$ or X may have a substituent(s), such as a halogen atom, an alkyl group, a cycloalkyl group, an alkenyl group, an aryl group, a heterocyclic group, a cyano group, a hydroxyl group, a nitro group, an alkoxy group, an aryloxy group, a heterocyclic oxy group, a silyloxy group, an acyloxy group, an alkoxycarbonyloxy group, a cycloalkyloxycarbonyloxy group, an aryloxycarbonyloxy group, a carbamoyloxy group, a sulfamoyloxy group, an alkanesulfonyloxy group, an arenesulfonyloxy group, a carboxyl group, an acyl group, an alkoxycarbonyl group, a cycloalkyloxycarbonyl group, an aryloxycarbonyl group, a carbamoyl group, an amino group, an anilino group, a heterocyclic amino group, a carbonamido group, an alkoxycarbonylamino group, an aryloxycarbonylamino group, a ureido group, a sulfonamido group, a sulfamoylamino group, an imido group, an alkylthio group, an arylthio group, a heterocyclic thio group, a sulfinyl group, a sulfo group, an alkanesulfonyl group, an arenesulfonyl group, a sulfamoyl group, or a phosphonyl group.

The compound represented by formula (M-I) includes oligomers inclusive of dimers and polymers formed at $R_1$, $R_2$, $R_3$ or X.

Preferred ranges of the compound represented by formula (M-I) are described below.

In formula (Q-1), $R_4$ preferably represents an alkyl group. $R_5$ and $R_6$ each preferably represent an alkyl group, a cycloalkyl group, an aryl group, a hydroxyl group, an alkoxy group, an aryloxy group, an amino group, an anilino group, a carbonamido group, a ureido group, a sulfonamido group, a sulfamoylamino group, an imido group, an alkylthio group or an arylthio group, still preferably an alkyl group, a cycloalkyl group or an aryl group, and most preferably an alkyl group.

In formula (Q-2), RT preferably represents a secondary or tertiary alkyl group represented by formula (Q-4), a cycloalkyl group or an aryl group, still preferably a secondary or tertiary alkyl group represented by formula (Q-4) or a cycloalkyl group. Rs preferably represents an alkyl group, a cycloalkyl group or an aryl group, still preferably an alkyl group or a cycloalkyl group.

In formula (Q-3), $R_9$ and $R_{10}$ each preferably represent a halogen atom, an alkyl group, a cycloalkyl group, an aryl group, an alkoxy group, an aryloxy group, an acyl group, an alkoxycarbonyl group, a cycloalkyloxycarbonyl group, an aryloxycarbonyl group, a carbamoyl group, an amino group, an anilino group, a carbonamido group, an alkoxycarbonylamino group, an aryloxycarbonylamino group, a ureido group, a sulfonamido group, a sulfamoylamino group, an imido group, an alkylthio group, an arylthio group, a heterocyclic thio group, a sulfinyl group, an alkanesulfonyl group, an arenesulfonyl group, a sulfamoyl group or a phosphonyl group, still preferably a halogen atom, an alkyl group, a cycloalkyl group, an aryl group, an alkoxy group, an aryloxy group, an amino group, an anilino group, a carbonamido group, a ureido group, a sulfonamido group, a sulfamoylamino group, an alkylthio group or an arylthio group, most preferably an alkyl group, a cycloalkyl group, an aryl group, an alkoxy group, an aryloxy group, an alkylthio group or an arylthio group. m preferably represents an integer of 0 to 3, still preferably 1 or 2.

$R_1$ preferably represents a group represented by formula (Q-1) or (Q-2), still preferably a group represented by formula (Q-1), particularly a group represented by formula (Q-1) wherein $R_4$, $R_5$, and $R_6$ all represent an alkyl group. $R_1$ most preferably represents a t-butyl group. Specific but nonlimiting examples of the preferred group as $R_1$ are shown below.

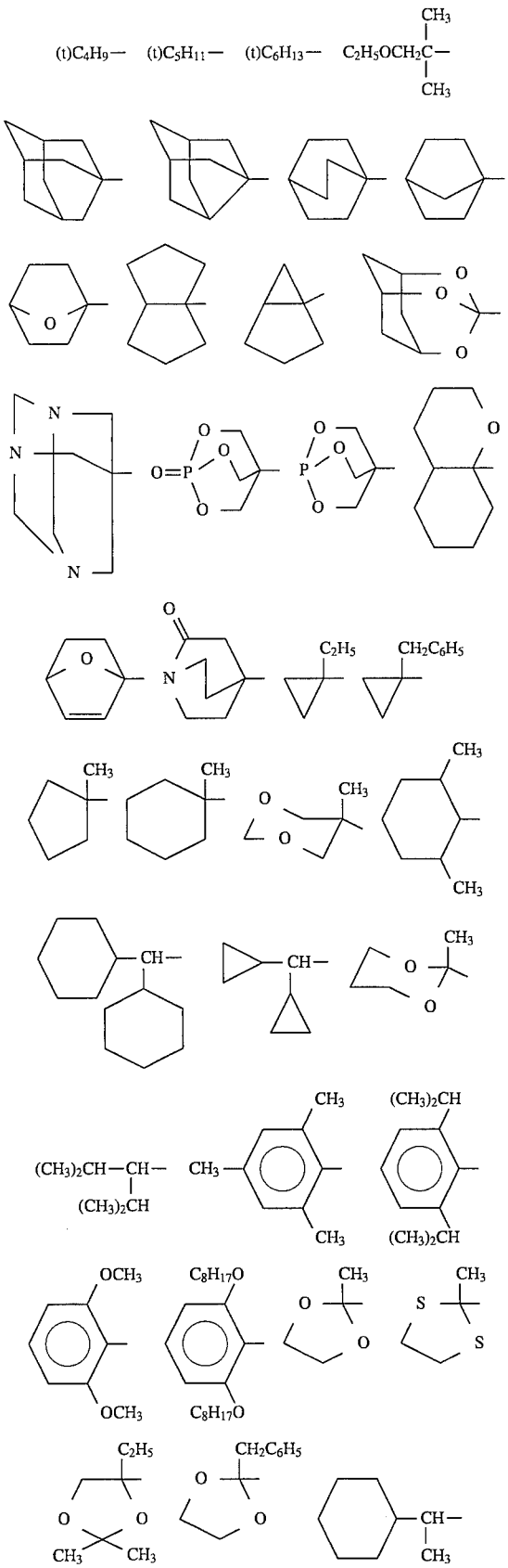

-continued

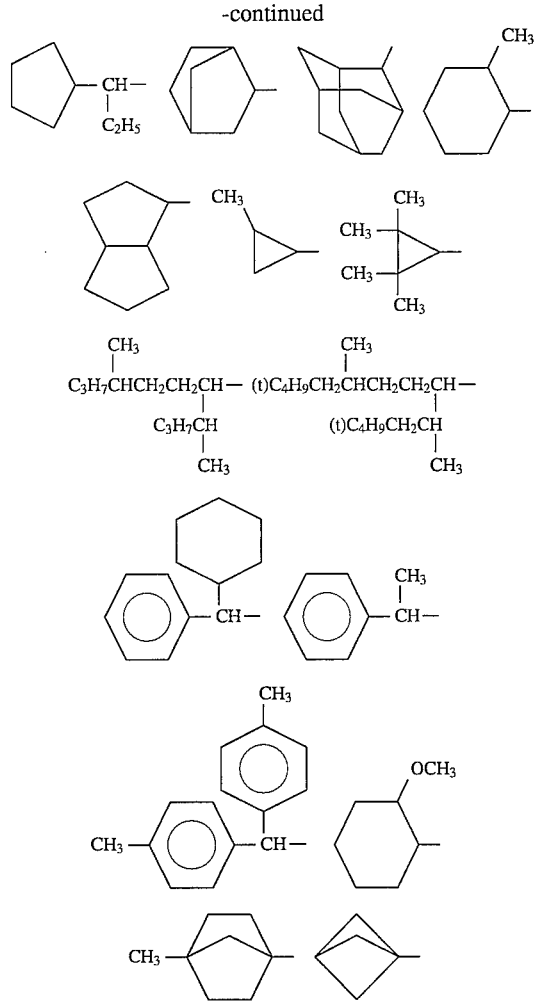

$R_2$ preferably represents an alkoxy group, an aryloxy group, an acyloxy group, an alkoxycarbonyloxy group, a cycloalkyloxycarbonyloxy group, an aryloxycarbonyloxy group, a carbamoyloxy group, a sulfamoyloxy group, an alkanesulfonyloxy group, an arenesulfonyloxy group, an acyl group, an alkoxycarbonyl group, a cycloalkyloxycarbonyl group, an aryloxycarbonyl group, a carbamoyl group, an amino group, an anilino group, a carbonamido group, an alkoxycarbonylamino group, an aryloxycarbonylamino group, a ureido group, a sulfonamido group, a sulfamoylamino group, an imido group, an alkylthio group, an arylthio group, a heterocyclic thio group, an alkanesulfonyl group, an arenesulfonyl group or a sulfamoyl group, still preferably an alkoxy group, an aryloxy group, an acyl group, an alkoxycarbonyl group, a cycloalkyloxycarbonyl group, an aryloxycarbonyl group, a carbamoyl group, an amino group, an anilino group, a carbonamido group, an alkoxycarbonylamino group, an aryloxycarbonylamino group, a ureido group, a sulfonamido group, a sulfamoylamino group, an imido group, an alkylthio group, an arylthio group or a sulfamoyl group. The position of $R_2$ is preferably at the meta-or para-position, still preferably para-position, with respect to the carbon atom bonded to the pyrazolotriazole ring.

$R_3$ preferably represents a fluorine atom, a chlorine atom, a bromine atom, an alkyl group, a cycloalkyl group, an aryl group, a heterocyclic group, a cyano group, a hydroxyl group, a nitro group, an alkoxy group, an aryloxy group, a carboxyl group, an acyl group, an alkoxycarbonyl group, a cycloalkyloxycarbonyl group, an aryloxycarbonyl group, a carbamoyl group, an amino group, an anilino group, a carbonamido group, an alkoxycarbonylamino group, an aryloxycarbonylamino group, a ureido group, a sulfonamido group, a sulfamoylamino group, an imido group, an alkylthio group, an arylthio group, a heterocyclic thio group, a sulfinyl group, a sulfo group, an alkanesulfonyl group, an arenesulfonyl group, a sulfamoyl group or a phosphonyl group. n preferably represents an integer of 0 to 3, still preferably 0 or 1.

X preferably represents a chlorine atom, a bromine atom, an aryloxy group, an alkylthio group, an arylthio group, a heterocyclic thio group or a heterocyclic group, still preferably a chlorine atom or an aryloxy group, most preferably a chlorine atom. Specific but non-limiting examples of preferred groups as X are shown below.

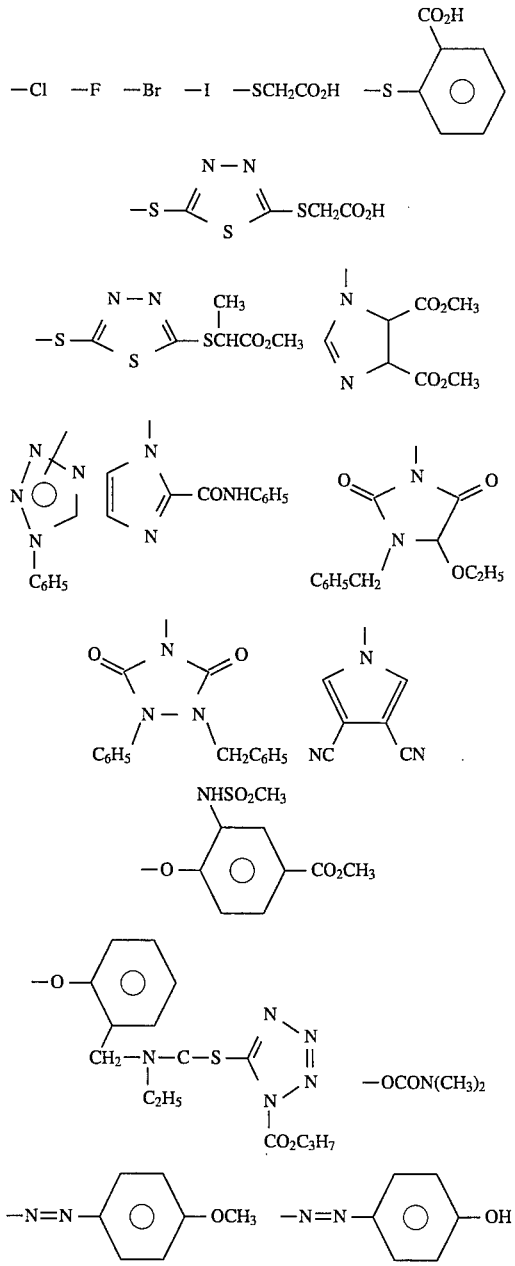

-continued

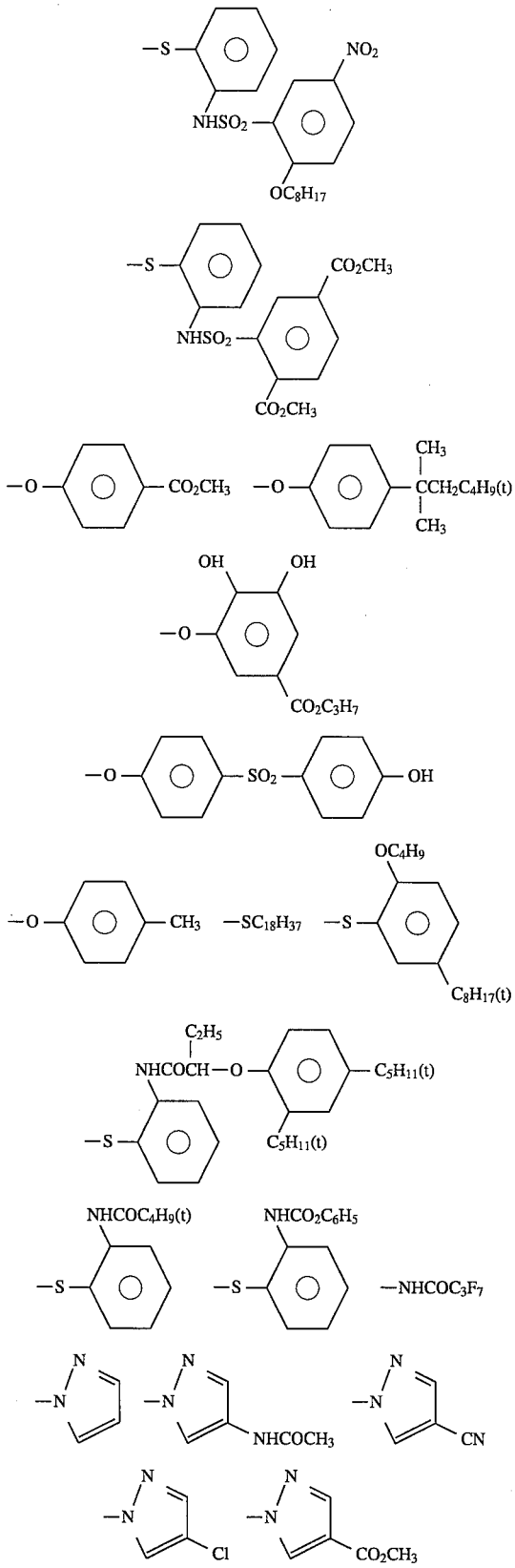

-continued

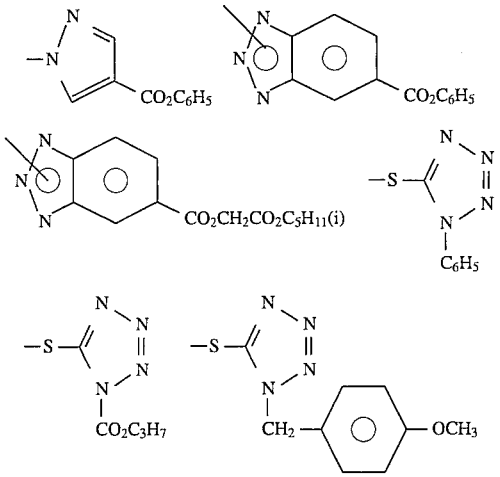

Of the compounds represented by formula (M-I) preferred from the standpoint of the effects obtained are those represented by formula (M-II):

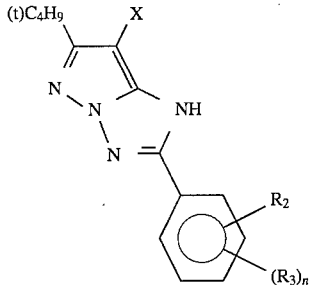

(M-II)

wherein $R_2$, $R_3$, n, and X are as defined in formula (M-I).

Of the compounds represented by formula (M-II), still preferred are those represented by formula (M-III):

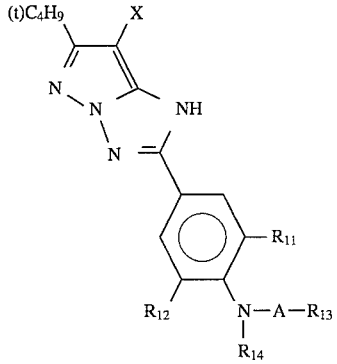

(M-III)

wherein $R_{11}$ and $R_{12}$ each represent a hydrogen atom or a substituent; A represents —CO— or —$SO_2$—; $R_{13}$ represents an alkyl group, an aryl group, an alkoxy group, an alkylamino group or an anilino group; $R_{14}$ represents a hydrogen atom, an alkyl group, an aryl group, an acyl group, an alkanesulfonyl group or an arenesulfonyl group; X represents a hydrogen atom or a group releasable on coupling reaction with an oxidation product of a developing agent; and $R_{13}$ and $R_{14}$ may be taken together to form a 5- to 7-membered ring.

In formula (M-III), $R_{11}$ and $R_{12}$ each preferably represent a hydrogen atom, a fluorine atom, a chlorine atom, a bromine atom, an alkyl group, a cycloalkyl group, an aryl group, a heterocyclic group, a cyano group, a hydroxyl group, a nitro group, an alkoxy group, an aryloxy group, a carboxyl group, an acyl group, an alkoxycarbonyl group, a cycloalkyloxycarbonyl group, an aryloxycarbonyl group, a carbamoyl group, an amino group, an anilino group, a carbonamido group, an alkoxycarbonylamino group, an aryloxycarbonylamino group, a ureido group, a sulfonamido group, a sulfamoylamino group, an imido group, an alkylthio group, an arylthio group, a heterocyclic thio group, a sulfinyl group, a sulfo group, an alkanesulfonyl group, an arenesulfonyl group, a sulfamoyl group or a phosphonyl group. $R_{13}$ preferably represents an alkyl group or an aryl group. $R_{14}$ preferably represents a hydrogen atom or an alkyl group. A preferably represents —CO—. X preferably represents a hydrogen atom, a chlorine atom, a bromine atom, aryloxy group, an alkylthio group, an arylthio group, a heterocyclic thio group or a heterocyclic group, still preferably a chlorine atom or an aryloxy group, most preferably a chlorine atom.

Specific examples of the pyrazolotriazole magenta couplers represented by formula (M-I) are shown below only for illustrative purposes but not for limitation.

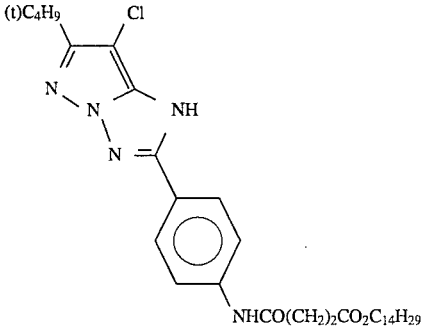
M-1
M-1 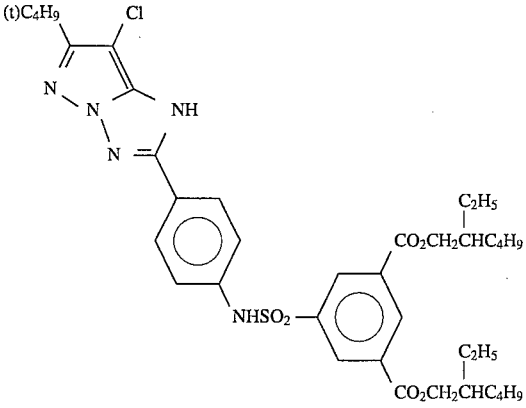
M-2
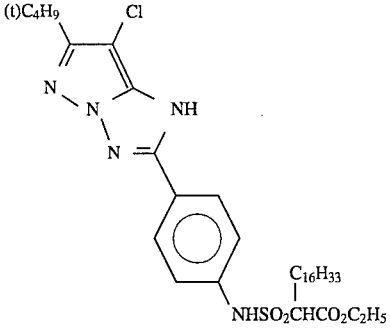
M-3
M-3 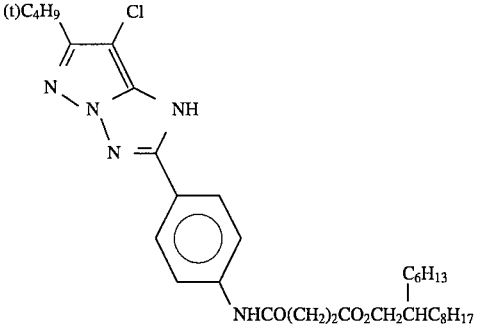
M-4
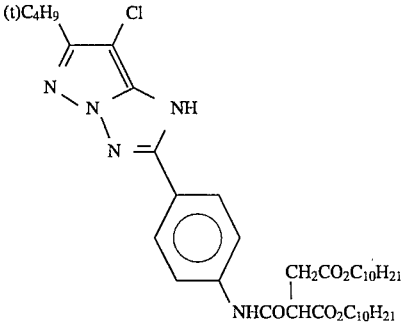
M-5
M-5 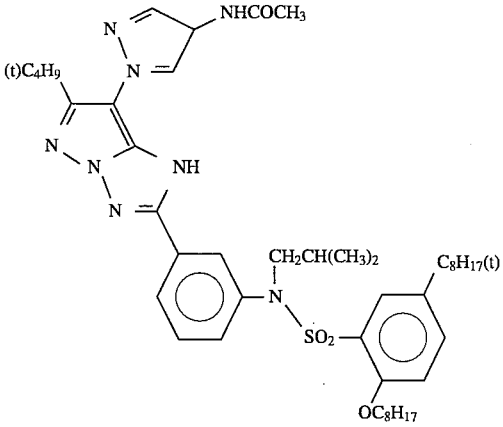
M-6
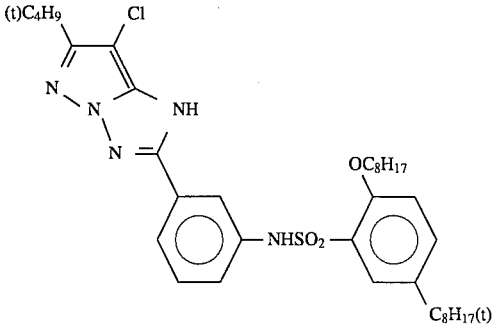
M-7
M-7 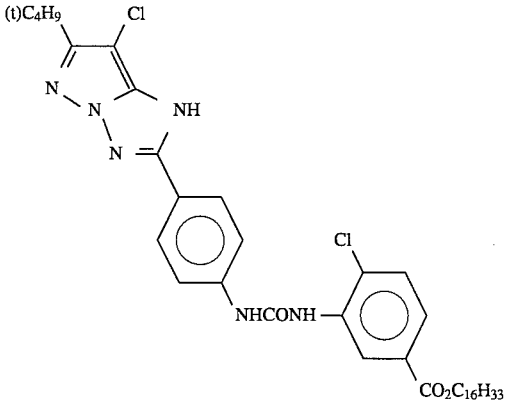
M-8

-continued
M-9
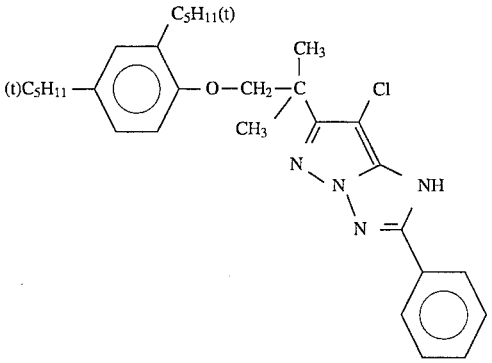
M-10
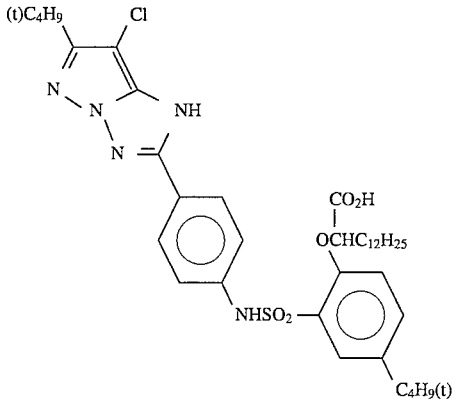
M-11
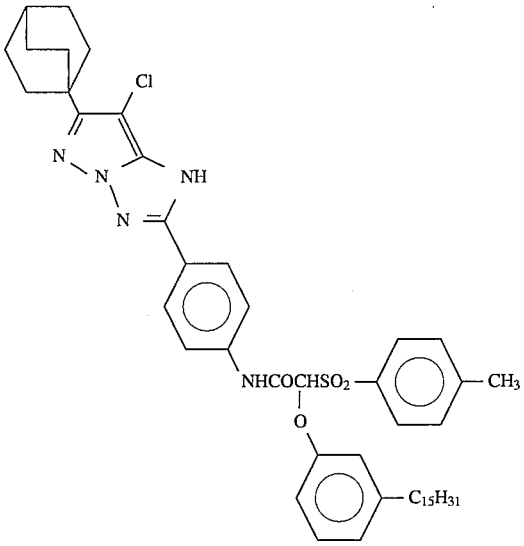
M-12
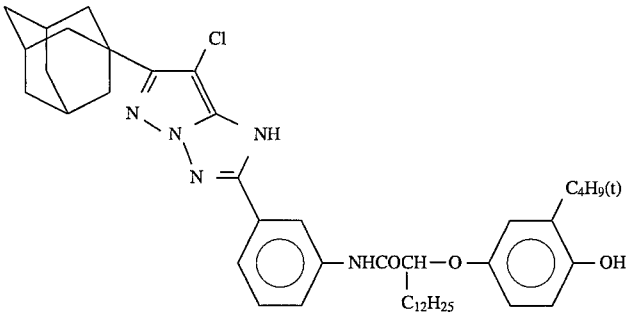

-continued
M-13
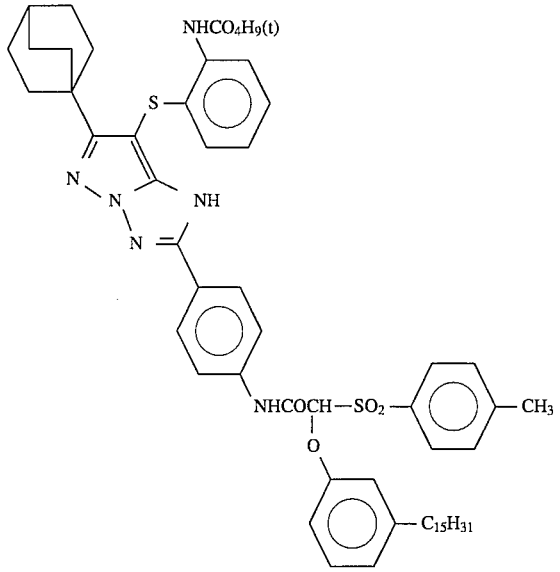
M-14
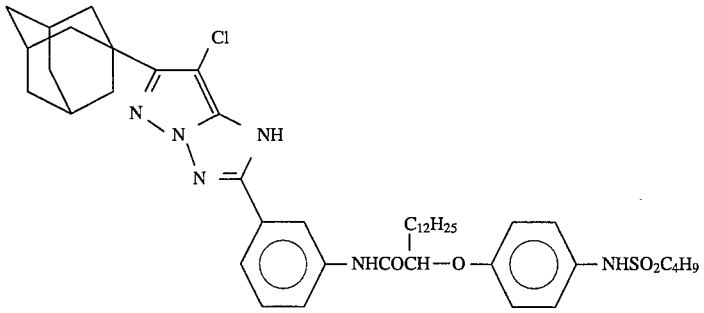
M-15
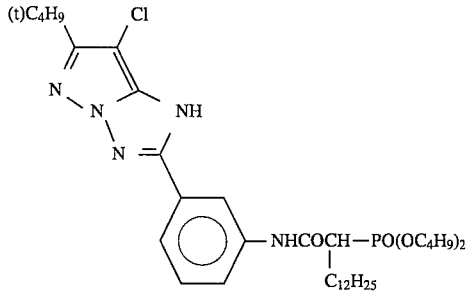
M-16
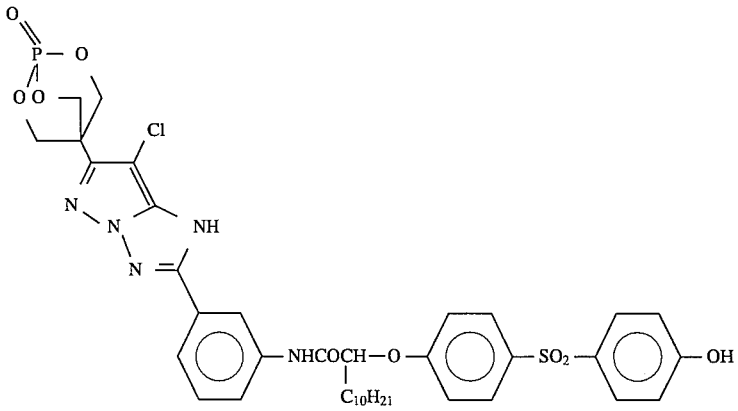

-continued
M-17
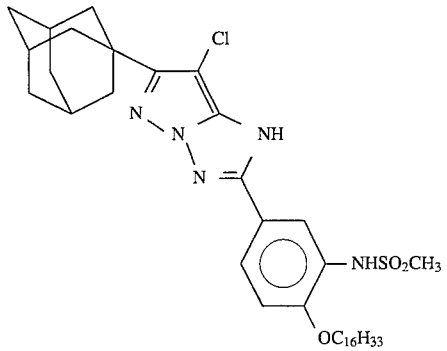
M-18
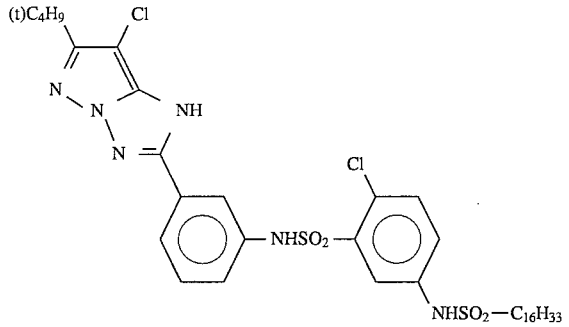
M-19
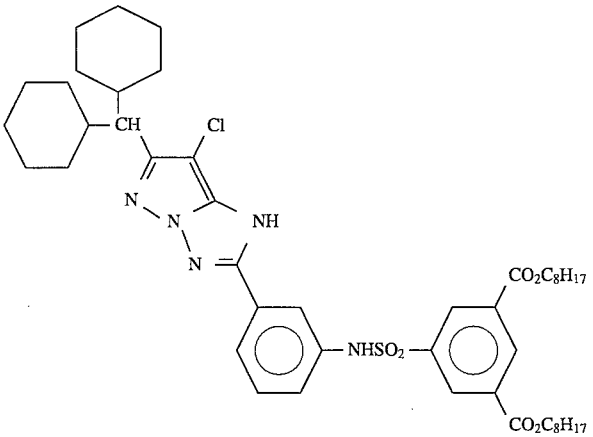
M-20
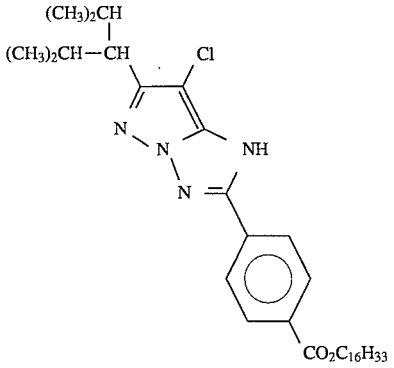

-continued
M-21
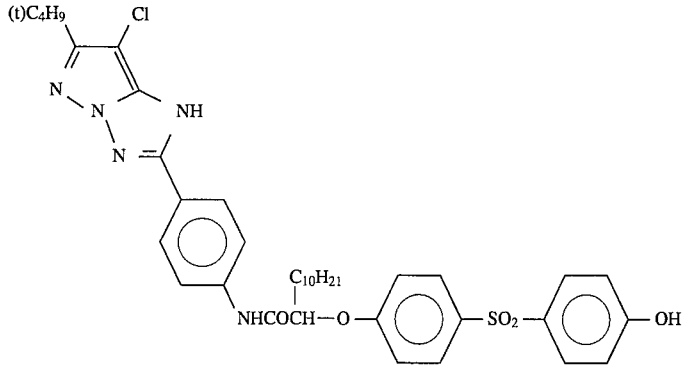
M-22
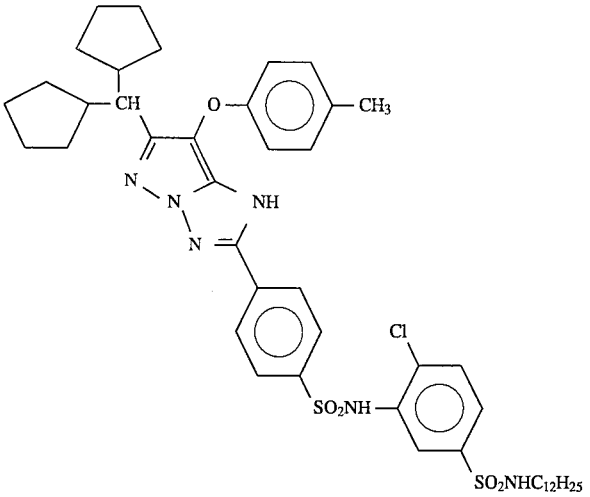
M-23
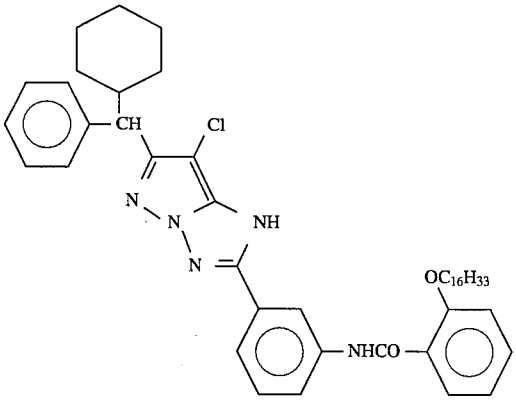
M-24
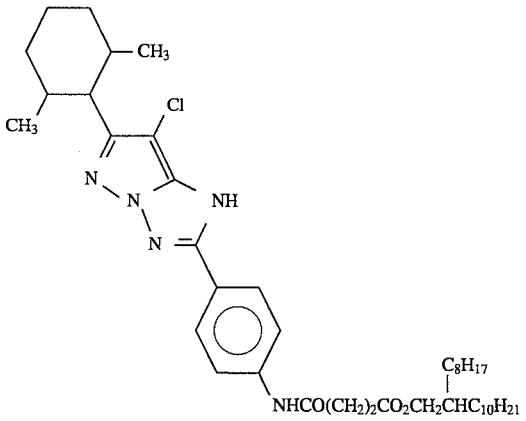
M-25
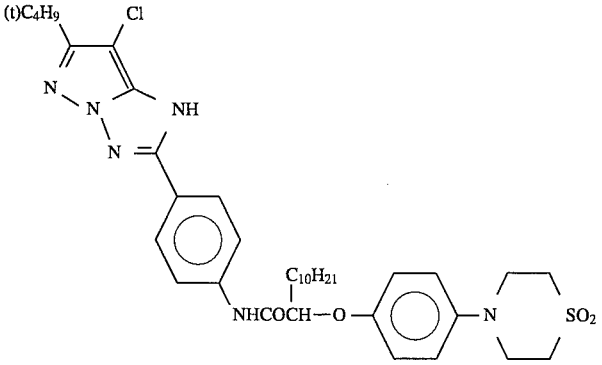

-continued
M-26
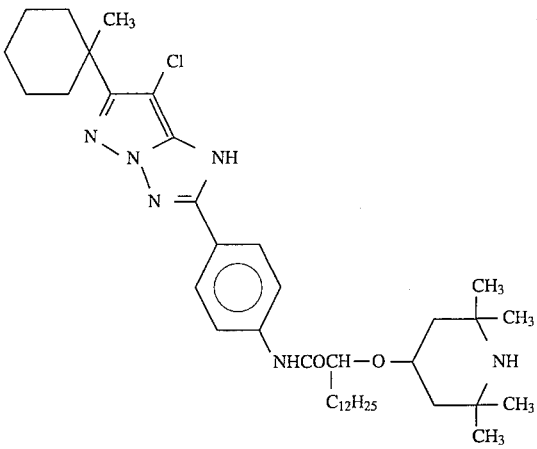
M-27
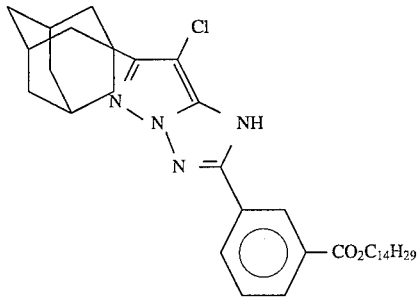
M-28
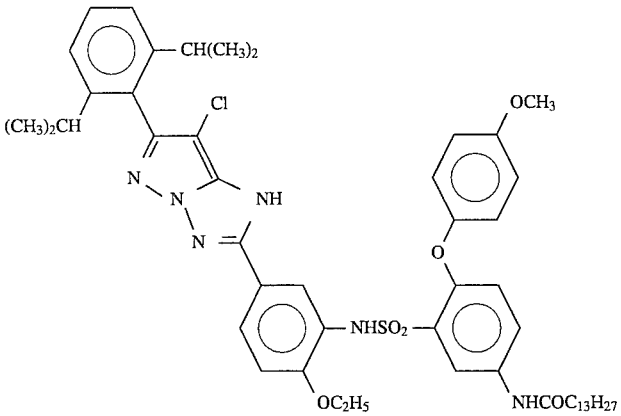
M-29
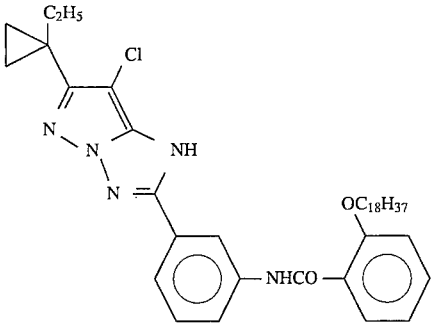
M-30
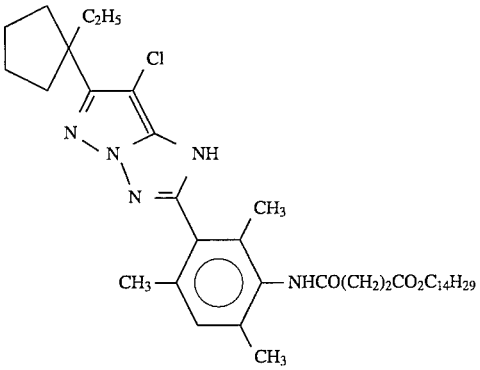
M-31
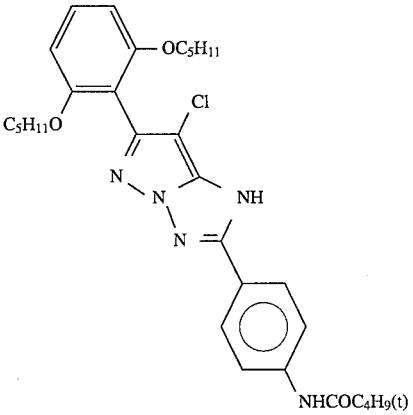

-continued

M-32

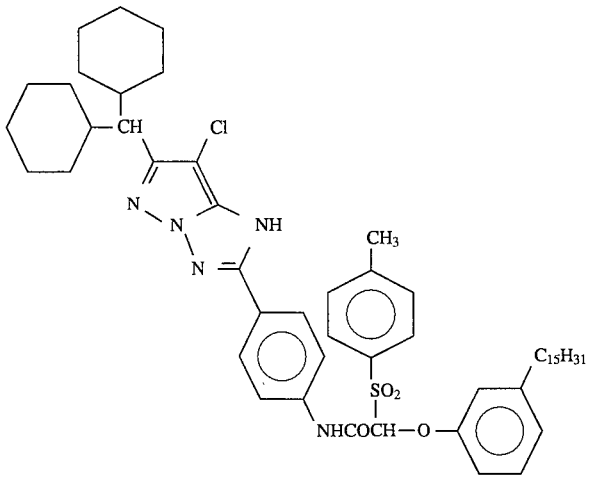

M-33

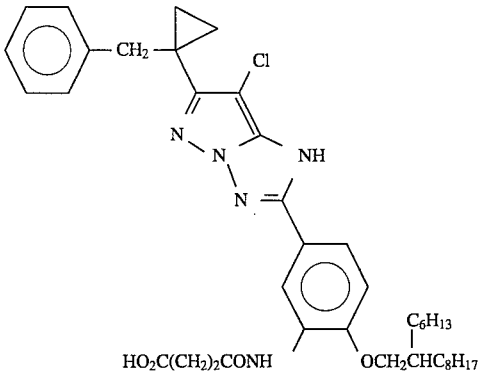

The pyrazolotriazole couplers of formula (M-I) can be synthesized in accordance with the method described in EP-A2-571959 or any other known methods.

The coupler of formula (M-I) is preferably used in an amount of from about 0.1 tol mol per mol of silver halide of the layer where it is used.

The silver halide light-sensitive material according to the present invention preferably has a reflection density of not less than 0.3, still preferably not less than 0.5, at a wavelength of 550 nm. If the reflection density is less than 0.3, it is difficult to obtain an image with excellent sharpness.

The reflection density of a light-sensitive material can be measured with a commonly employed reflection densitometer and is defined as follows:

Reflection Density $=-\text{Log}\{F\ (550\ \text{nm})/F_0\ (550\ \text{nm})\}$ wherein $F_0$ (550 nm) is a quantity of light reflected on a standard white board (at a wavelength of 550 nm); and F (550 nm) is a quantity of light reflected on a sample (at a wavelength of 550 nm).

The reflection density of a light-sensitive material can be increased to 0.3 or more preferably by adding to a hydrophilic colloidal layer a dye which can be decolored on processing (i.e., oxonol dyes or cyanine dyes) as described in EP-A2-337490. In using these dyes, it is recommended to choose a dye whose absorption overlaps the spectral sensitivity maximum of the light-sensitive layer.

Some of these water-soluble dyes show deteriorated color release if used in an increased amount. It is preferable to use water-soluble dyes which can be used without undergoing deterioration of color release, such as those described in EP-A1-539978, JP-A-5-127325, and JP-A-5-127324.

The above-mentioned water-soluble dyes may be used in combination with a colored layer which can be decolored on processing. A colored layer which can be decolored by processing may be provided in direct contact with an emulsion layer or via an intermediate layer containing gelatin and a color mixing inhibitor, such as a hydroquinone. The colored layer is preferably provided below (closer to the support than) an emulsion layer whose spectral sensitivity maximum is in the absorption region of the colored layer. A colored layer corresponding to every primary color may be provided, or a color layer corresponding to a part of the primary colors may be provided. A colored layer corresponding to a plurality of primary color regions may be provided.

A colored layer can be formed in a conventional manner. For example, a coloring matter is incorporated into a hydrophilic colloidal layer in the form of a dispersion of fine solid particles as described in JP-A-2-282244, page 3, upper right column to page 8 and JP-A-3-7931,, page, 3, upper right column to page 11, lower left column; an anionic dye is fixed to a cation polymer via a mordant; a coloring matter is adsorbed onto fine particles of silver halide, etc. and fixed in a layer; or colloidal silver is utilized as a light absorber as described in JP-A-1-239544. As for dispersion of fine solid particles of a coloring matter, a method of incorporating fine particles of a dye which is substantially water-insoluble at a pH of 6 or lower but is substantially water-soluble at a pH of 8 or higher is disclosed in JP-A-2-308244, pp. 4 to 13. The method for mordanting a cation polymer for fixing of an anionic dye is described in JP-A-2-84637, pp. 18 to 26. Preparation of colloidal silver as a light absorber is described in U.S. Pat. Nos. 2,688,601 and 3,459,563. It is also preferable to use tabular thin colloidal silver grains having a thickness of up to 20 nm as described in JP-A-5-134358. Of these methods, the method of incorporating fine particles of a dye and the method of using colloidal silver are recommended.

In the present invention, it is particularly preferable to use a water-soluble dye represented by formula (IX) either alone or in combination with the above-mentioned water-soluble dye:

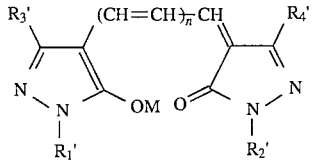

(IX)

wherein $R'_1$, $R'_2$, $R'_3$, and $R'_4$ each represent a hydrogen atom or a substituent, provided that at least one of the total atomic weight of $R'_1$ and $R'_3$ and the total atomic weight of $R'_2$ and $R'_4$ is not more than 160; n represents 0, 1 or 2; and M represents a hydrogen atom or an alkali metal.

In formula (IX), at least one of, preferably both of, the atomic weight of $R'_1$ and $R'_3$ and the total atomic weight of $R'_2$ and $R'_4$ should be 160 or less, still preferably 130 or less.

$R'_1$, $R'_2$, $R'_3$, and $R'_4$ are preferably selected from a hydrogen atom, an alkyl group, —$COOR'_5$, —$CONR'_6R'_7$, —$CONHR'_8$, —$NR'_9COR'_{10}$, —$NR'_{11}R'_{12}$, —CN, —$OR'_{13}$ or —$NR'_{14}CONR'_{15}R'_{16}$, wherein $R'_5$, $R'_6$, $R'_7$, $R'_8$, $R'_9$, $R'_{10}$, $R'_{11}$, $R_{12}$, $R'_{13}$, $R'_{14}$, $R'_{15}$, and $R'_{16}$ each represent a hydrogen atom or a substituted or unsubstituted alkyl group; $R'_6$ and $R'_7$, $R'_{11}$ and $R'_{12}$, or $R'_{15}$ and $R'_{16}$ may be taken together to form a ring. It is still preferable that $R'_1$, $R'_2$, $R'_3$, and $R'_4$ each have no dissociation group. The term "dissociation group" as used herein means a substituent which is substantially dissociated in water at 25° C. and has a pKa of not more than 12. Such a dissociation group includes a sulfonic acid group, a carboxyl group, and a phosphoric acid group.

Still preferably, $R'_1$ and $R'_2$ each represent a hydrogen atom or an alkyl group. The alkyl group is preferably an alkyl group having 3 or less carbon atoms, e.g., methyl, ethyl or propyl, which may have a substituent(s). The substituent preferably includes those having a non-covalent electron pair, such as a hydroxyl group, an ether group, an ester group, a carbamoyl group, a sulfonyl group, a sulfamoyl group, and a cyano group, still preferably a hydroxyl group and an ether group. $R'_1$ and $R'_2$ each most preferably represent a methyl group.

The alkali metal as represented by M is preferably Li, Na, K or Cs.

The alkyl group as represented by $R'_3$ and/or $R'_4$ is preferably a lower alkyl group, such as a methyl, ethyl, propyl or butyl group.

When $R'_3$ and/or $R'_4$ represent —$COOR'_5$, the alkyl group as $R'_5$ is preferably a lower alkyl group, such as a methyl, ethyl, propyl or butyl group, with a methyl or ethyl group being particularly preferred.

When $R'_3$ and/or $R'_4$ represent —$CONR'_6R'_7$, $R'_6$ and $R'_7$ each represent a hydrogen atom or an alkyl group. At least one of $R'_6$ and $R'_7$ is preferably an alkyl group. The alkyl group is preferably a methyl group, an ethyl group or a propyl group, which may have a substituent. The substituent preferably includes a hydroxyl group and an ether group. $R'_6$ and $R'_7$ may be taken together to form a ring, preferably a morpholine ring.

When $R'_3$ and/or $R'_4$ represent —$CONHR'_8$, and $R'_8$ is an alkyl group, the alkyl group has the same meaning as R'6 and $R'_7$.

When $R'_3$ and/or $R'_4$ represent —$NR'_9COR'_{10}$, $R'_9$ and $R'_{10}$ each represent a hydrogen atom or an alkyl group. The alkyl group is preferably a methyl group, an ethyl group or a propyl group, which may have a substituent, with a methyl group being still preferred. The substituent preferably includes a hydroxyl group and an ether group.

When $R'_3$ and/or $R'_4$ represent —$NR'_{11}R'_{12}$ or —$OR'_{13}$, $R'_{11}$, $R'_{12}$ and $R'_{13}$ each represent a hydrogen atom or an alkyl group. The alkyl group is preferably a methyl group, an ethyl group or a propyl group, which may have a substituent. The substituent preferably includes a hydroxyl group and an ether group. $R'_{11}$ and $R'_{12}$ may be taken together to form a ring.

When $R'_3$ and/or $R'_4$ represent —$NR'_{14}CONR'_{15}R'_{16}$, $R'_{14}$, $R'_{15}$, and $R'_{16}$ each represent a hydrogen atom or an alkyl group. The alkyl group is preferably a methyl group, an ethyl group or a propyl group, with a methyl group being still preferred, which may have a substituent. The substituent preferably includes a hydroxyl group and an ether group.

Of the above-mentioned groups, $R'_3$ and $R'_4$ each preferably represent —$CONR'_6R'_7$, still preferably —$CONR'_6R'_7$ in which $R'_6$ and $R'_7$ are taken together to form a 5- or 6-membered ring, and most preferably —$CONR'_6R'_7$ in which $R'_6$ and $R'_7$ form a morpholine ring as is shown in formula (X). That is, the preferred of the water-soluble dyes of formula (IX) are those represented by formula (X):

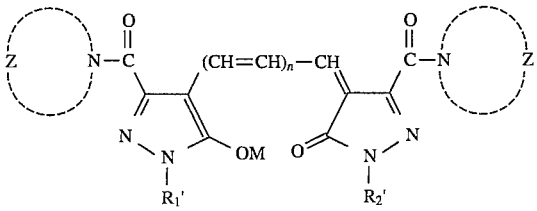

(X)

wherein $R'_1$ and $R'_2$ are represents a hydrogen atom or a substituent; n represents 0, 1 or 2; M represents a hydrogen atom or an alkali metal; Z represents an atomic group necessary to form a 5- or 6-membered saturated heterocyclic group together with the nitrogen atom; provided that at least one of the total atomic weight of $R'_1$ and Z and the total atomic weight of $R'_2$ and Z is not more than 120.

The dye is preferably present in a coating film in a molecular dispersion state like a monomolecule or a dimer. The terminology "molecular dispersion state" as used herein means that the water-soluble dye represented by formula (IX) or (X) is dispersed in an emulsion layer or any other hydrophilic colloidal layer almost uniformly, showing substantial no solid state. A still preferred state of the dye is the state of a monomolecule or a dimer. Specific examples of the water-soluble dye of formula (IX) which can be used in the present invention are shown below only for illustrative purposes but not for limitation.

TABLE 1

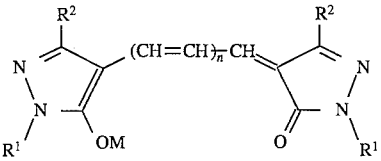

| | $R^1$ | $R^2$ | n | M |
|---|---|---|---|---|
| 1 | H | $CONHCH_2CH_2OH$ | 0 | K |
| 2 | H | $CON(CH_3)_2$ | 1 | K |

TABLE 1-continued

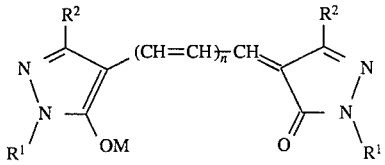

| | $R^1$ | $R^2$ | n | M |
|---|---|---|---|---|
| 3 | H | 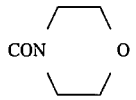 | 1 | K |
| 4 | $CH_3$ | $CONHCH_2CH_2OCH_3$ | 1 | K |
| 5 | $CH_2CH_3$ | $CONHCH_2CH_2OH$ | 1 | K |
| 6 | $CH_2CH_2OH$ | 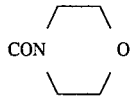 | 1 | K |
| 7 | $CH_2CH_2OH$ | $CONHCH_2CH_2OH$ | 0 | K |
| 8 | $CH_2CH_2OH$ | $CONHCH_3$ | 1 | K |

TABLE 2

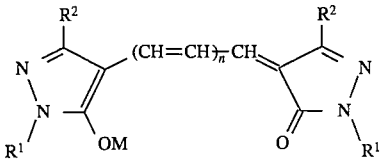

| | $R^1$ | $R^2$ | n | M |
|---|---|---|---|---|
| 9 | H | $CONHCH_2CH_2OH$ | 1 | K |
| 10 | H | $CON(CH_3)_2$ | 2 | K |
| 11 | $CH_3$ | 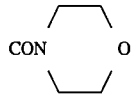 | 1 | K |
| 12 | $CH_3$ | $CONHCH_2CH_2OCH_3$ | 2 | Na |
| 13 | $CH_2CH_3$ | $CONHCH_2CH_2OH$ | 2 | K |
| 14 | $CH_2CH_2OH$ | 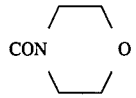 | 2 | K |
| 15 | $CH_2CH_2OH$ | $CONHCH_2CH_2OH$ | 2 | K |
| 16 | $CH_2CH_2OH$ | $CONHCH_3$ | 2 | K |

TABLE 3

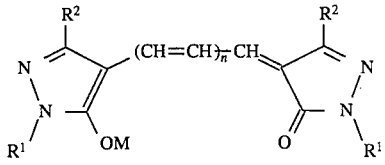

| | $R^1$ | $R^2$ | n | M |
|---|---|---|---|---|
| 17 | H | $COOC_2H_5$ | 0 | K |
| 18 | H | $COOCH_3$ | 1 | K |
| 19 | $CH_3$ | $COOC_2H_5$ | 1 | Na |
| 20 | $CH_3$ | $COOCH_2CH_2OCH_3$ | 1 | K |
| 21 | $CH_2CH_3$ | $COOC_2H_5$ | 0 | K |

TABLE 3-continued

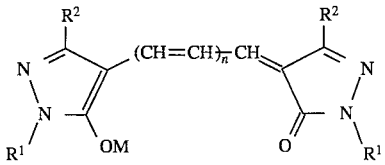

| | $R^1$ | $R^2$ | n | M |
|---|---|---|---|---|
| 22 | $CH_2COOC_2H_5$ | $COOC_2H_5$ | 1 | K |
| 23 | $CH_2CH_2OH$ | $COOC_2H_5$ | 1 | K |

TABLE 4

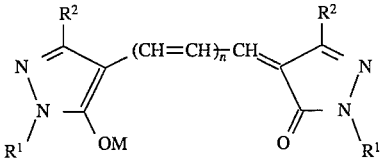

| | $R^1$ | $R^2$ | n | M |
|---|---|---|---|---|
| 24 | H | $COOC_2H_5$ | 1 | K |
| 25 | H | $COOCH_3$ | 2 | K |
| 26 | $CH_3$ | $COOC_2H_5$ | 2 | K |
| 27 | $CH_3$ | $COOCH_2CH_2OCH_3$ | 2 | K |
| 28 | $CH_2CH_3$ | $COOC_2H_5$ | 2 | K |
| 29 | $CH_2COOC_2H_5$ | $COOC_2H_5$ | 2 | K |
| 30 | $CH_2CH_2OH$ | $COOC_2H_5$ | 2 | K |

TABLE 5

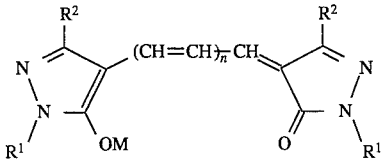

| | $R^1$ | $R^2$ | n | M |
|---|---|---|---|---|
| 31 | H | CN | 0 | K |
| 32 | H | CN | 1 | K |
| 33 | $CH_3$ | CN | 0 | K |
| 34 | $CH_3$ | CN | 1 | K |
| 35 | $CH_2CH_3$ | CN | 1 | K |
| 36 | $CH_2CH_3$ | CN | 2 | K |
| 37 | H | CN | 2 | K |
| 38 | $CH_3$ | CN | 2 | K |

TABLE 6

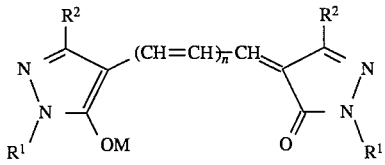

| | $R^1$ | $R^2$ | n | M |
|---|---|---|---|---|
| 39 | H | $CH_3$ | 1 | K |
| 40 | H | $CH_2CH_3$ | 1 | K |
| 41 | $CH_3$ | H | 1 | Na |
| 42 | $CH_3$ | $CH_3$ | 0 | K |
| 43 | $CH_2CH_3$ | $CH_3$ | 1 | K |
| 44 | $CH_2COOC_2H_5$ | $CH_3$ | 1 | K |

TABLE 6-continued

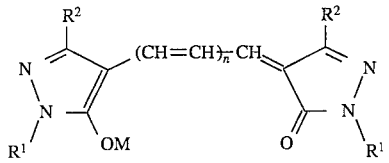

| | $R^1$ | $R^2$ | n | M |
|---|---|---|---|---|
| 45 | $CH_2CH_2OH$ | $CH_3$ | 1 | K |
| 46 | $CH_2CH_2OH$ | $CH_2CH_3$ | 1 | K |

TABLE 7

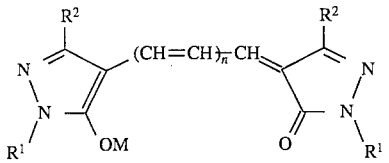

| | $R^1$ | $R^2$ | n | M |
|---|---|---|---|---|
| 47 | H | $CH_3$ | 2 | K |
| 48 | H | $CH_2CH_3$ | 2 | K |
| 49 | $CH_3$ | H | 2 | K |
| 50 | $CH_3$ | $CH_3$ | 2 | K |
| 51 | $CH_2CH_3$ | $CH_3$ | 2 | K |
| 52 | $CH_2COOC_2H_5$ | $CH_3$ | 2 | K |
| 53 | $CH_2CH_2OH$ | $CH_3$ | 2 | K |
| 54 | $CH_2CH_2OH$ | $CH_2CH_3$ | 2 | K |

TABLE 8

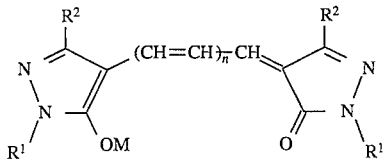

| | $R^1$ | $R^2$ | n | M |
|---|---|---|---|---|
| 55 | H | $OC_2H_5$ | 1 | K |
| 56 | H | $OC_2H_5$ | 2 | K |
| 57 | $CH_3$ | $OC_2H_5$ | 2 | K |
| 58 | $CH_3$ | OH | 1 | K |
| 59 | $CH_2CH_3$ | $OC_2H_5$ | 2 | K |
| 60 | $CH_2COOC_2H_5$ | $OC_2H_5$ | 2 | K |
| 61 | $CH_2CH_2OH$ | $OC_2H_5$ | 1 | K |
| 62 | $CH_2CH_2OH$ | $OC_2H_5$ | 2 | K |

TABLE 9

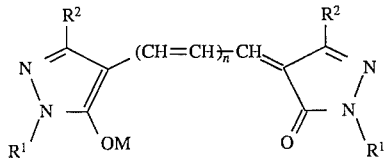

| | $R^1$ | $R^2$ | n | M |
|---|---|---|---|---|
| 63 | H | $OC_2H_5$ | 0 | K |
| 64 | H | $OCH_2CH_2OH$ | 1 | K |
| 65 | $CH_3$ | $OC_2H_5$ | 0 | K |
| 66 | $CH_3$ | OH | 2 | K |
| 67 | $CH_2CH_3$ | $OC_2H_5$ | 1 | K |
| 68 | $CH_2COOC_2H_5$ | $OC_2H_5$ | 1 | K |

TABLE 9-continued

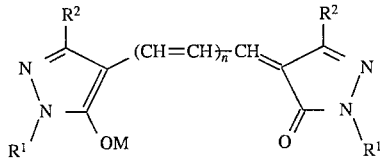

| | $R^1$ | $R^2$ | n | M |
|---|---|---|---|---|
| 69 | $CH_2CH_2OH$ | $OC_2H_5$ | 0 | K |
| 70 | $CH_2CH_2OH$ | $OCH_2CH_2OH$ | 1 | K |

TABLE 10

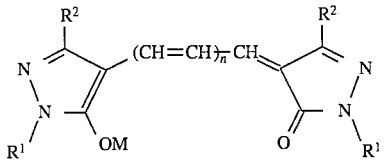

| | $R^1$ | $R^2$ | n | M |
|---|---|---|---|---|
| 71 | H | $NH_2$ | 0 | K |
| 72 | H | $NHCH_2CH_2OH$ | 1 | K |
| 73 | $CH_3$ | $NHCH_2CH_2OH$ | 0 | K |
| 74 | $CH_3$ | $NHCH_2CH_2OH$ | 1 | K |
| 75 | $CH_2CH_3$ | $NHCH_2CH_2OH$ | 1 | K |
| 76 | $CH_2COOC_2H_5$ | $NHCH_2CH_2OH$ | 1 | K |
| 77 | $CH_2CH_2OH$ | $NHCH_2CH_2OH$ | 0 | K |
| 78 | $CH_2CH_2OH$ | $NHCH_2CH_2OH$ | 1 | K |

TABLE 11

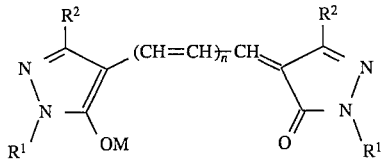

| | $R^1$ | $R^2$ | n | M |
|---|---|---|---|---|
| 79 | H | $NH_2$ | 1 | K |
| 80 | H | $NHCH_2CH_2OH$ | 2 | K |
| 81 | $CH_3$ | $NHCH_2CH_2OH$ | 2 | K |
| 82 | $CH_3$ | $NH_2$ | 1 | K |
| 83 | $CH_2CH_3$ | $NHCH_2CH_2OH$ | 2 | K |
| 84 | $CH_2COOC_2H_5$ | $NHCH_2CH_2OH$ | 2 | K |
| 85 | $CH_2CH_2OH$ | $NHCH_2CH_2OH$ | 2 | K |
| 86 | $CH_2CH_2OH$ | $NH_2$ | 1 | K |

TABLE 12

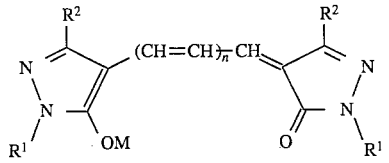

| | $R^1$ | $R^2$ | n | M |
|---|---|---|---|---|
| 87 | H | $NHCOCH_3$ | 1 | K |
| 88 | H | $NHCOCH_3$ | 2 | K |
| 89 | $CH_3$ | $NHCOCH_3$ | 1 | Na |
| 90 | $CH_3$ | $NHCOCH_3$ | 2 | K |
| 91 | $CH_2CH_3$ | $NHCOCH_3$ | 1 | K |
| 92 | $CH_2COOCH_3$ | $NHCOCH_3$ | 1 | K |

TABLE 12-continued

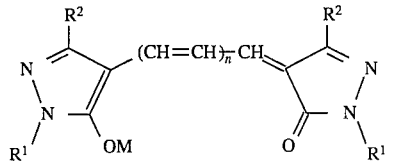

| | $R^1$ | $R^2$ | n | M |
|---|---|---|---|---|
| 93 | $CH_2CH_2OH$ | $NHCOCH_3$ | 1 | K |
| 94 | $CH_2CH_2OH$ | $NHCOCH_3$ | 2 | K |

TABLE 13

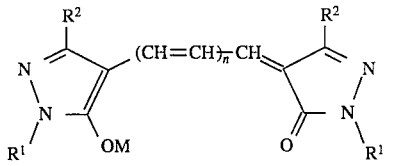

| | $R^1$ | $R^2$ | n | M |
|---|---|---|---|---|
| 95 | H | $NHCONHCH_3$ | 0 | K |
| 96 | H | $NHCONHCH_3$ | 1 | K |
| 97 | $CH_3$ | $NHCONHCH_3$ | 0 | K |
| 98 | $CH_3$ | $NHCONHCH_3$ | 1 | K |
| 99 | $CH_2CH_3$ | $NHCONHCH_3$ | 1 | K |

TABLE 14

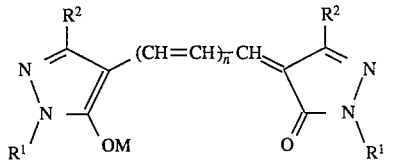

| | $R^1$ | $R^2$ | n | M |
|---|---|---|---|---|
| 100 | H | $NHCONHCH_3$ | 2 | K |
| 101 | H | $NHCON(CH_3)_2$ | 1 | K |
| 102 | $CH_3$ | $NHCONHCH_3$ | 2 | K |
| 103 | $CH_3$ | $NHCON(CH_3)_2$ | 2 | K |
| 104 | $CH_2CH_3$ | $NHCONHCH_3$ | 2 | K |

The dye to be used in the present invention can be dispersed on a molecular level in a hydrophilic colloidal layer (either light-sensitive or light-insensitive) by various known techniques. For example, the dye may be dispersed in a coating composition for a light-sensitive layer or a light-insensitive layer either directly or in the form of a solution in an appropriate solvent (e.g., methyl alcohol, ethyl alcohol, propyl alcohol, methyl cellosolve, a halogenated alcohol described in JP-A-48-9715 and U.S. Pat. No. 3,756,830, acetone, water, pyridine, etc. or a mixture thereof) and added in the form of a solution. The dye according to the present invention diffuses upon being applied throughout the layers constituting a light-sensitive material almost uniformly no matter which of a light-sensitive layer and a light-insensitive layer it may be added.

The amount of the dye to be used is not particularly limited but preferably ranges from 0.1 to 200 mg/m$^2$, still preferably from 1 to 100 mg/m$^2$.

The color light-sensitive material of the present invention comprises a reflective support having provided thereon at least three silver halide emulsion layers having different color sensitivity, i.e., at least one yellow-forming silver halide emulsion layer, at least one magenta-forming silver halide emulsion layer and at least one cyan-forming silver halide emulsion layer. General color paper achieves color reproduction by subtractive color process using color couplers forming a color complementary to the-light to which the silver halide emulsion of the same layer is sensitive. In general color paper, therefore, silver halide emulsion grains in the yellow-forming, magenta-forming or cyan-forming silver halide emulsion layer are spectrally sensitized with a blue-sensitive, green-sensitive or red-sensitive spectral sensitizing dye, respectively, and applied to a support in the order described above. In the case of color reversal paper, the silver halide emulsions spectrally sensitized by a blue-sensitive, green-sensitive and red-sensitive sensitizing dye are successively applied to a support in the order of a red-sensitive layer, a green-sensitive layer, and a blue-sensitive layer. The order of the layers may be different. For example, it is preferable in some cases from the standpoint of rapid processing that the uppermost layer is a light-sensitive layer containing silver halide grains having the largest mean grain size, and it is preferable in some cases from the standpoint of preservability under light irradiation that the undermost layer is a magenta-forming light-sensitive layer.

In some cases a light-sensitive layer and a developed hue may not satisfy the above-mentioned relationship. For example, at least one,infrared-sensitive silver halide emulsion layer may be provided.

Two or more light-sensitive layers may be provided for one color sensitivity. A light-insensitive layer for various purposes, such as a color mixing preventive layer, an anti-irradiation/antihalation antihalation layer, a filter layer, or a protective layer, may be provided between a light-sensitive layer and a support, between light-sensitive layers, or as an uppermost layer (the layer farthest from the support).

Any of silver chloride, silver bromide, silver chlorobromide, silver iodobromide, silver chlorobromide, silver chloroiodobromide, etc. may be employable as silver halide grains. Silver chloride, silver chlorobromide or silver chloroiodobromide grains having a silver chloride content of 95 mol % or more are preferred for achieving rapidness and simplicity of processing. For reduction of development processing time, substantially iodide-free silver chlorobromide or silver chloride emulsions are particularly preferred in the present invention. The term "substantially iodide-free" as used herein means that a silver iodide content is not more than 1 mol %, preferably not more than 0.2 mol %. For the purpose of increasing high illuminance sensitivity, spectral sensitivity or stability of a light-sensitive material against time, high silver chloride grains containing 0.01 to 3 mol % of silver iodide on their surface as described in JP-A-3-84545 are sometimes used to advantage. The halogen composition of emulsion grains may be the same or different among individual grains. Use of an emulsion having a uniform halogen composition among grains facilitates levelling of the properties among the individual grains. The halogen composition of individual emulsion grains may be homogeneous throughout the whole grain or heterogeneous as in a core/outer shell (single-layered or multi-layered) structure or a structure having a non-layered portion of different halogen composition in the inside or on the surface thereof (when the portion is on the surface of a grain, it is fused on the edge, corner or plane of the grain). Either of the latter heterogeneous structures is preferred to the former homogeneous structure for obtaining high sensitivity and also for assuring pressure resistance. In a heterogeneous structure, the boundary between two layers or portions different in halogen composition may be either clear or vague, forming a mixed crystal there. Continuous structural change may be positively given to the grain.

In the high silver chloride emulsion to be used in the present invention, silver halide grains preferably have a silver bromide phase localized in the inside and/or the surface thereof either in a layered or a non-layered structure as mentioned above. The localized silver bromide phase preferably has a silver bromide content of at least 10 mol %, still preferably more than 20 mol %. The silver bromide content in the localized silver bromide layer can be analyzed by X-ray diffractometry described, e.g., in Nippon Kagakukai (ed.), *Shin Jikken Kaqaku Koza 6, Kozo Kaiseki*, Maruzen. The localized silver bromide phase may be in the inside of the grains or on the edges, corners or planes of the grains. An epitaxially grown silver bromide phase fused on the corner of a grain may be mentioned as a suitable example.

For the purpose of reducing the amount of a replenisher for a developing solution, it is effective to further increase the silver chloride content of the emulsion to, e.g., 98 to 100 mol %, that is, to use nearly pure silver chloride.

The mean grain size of silver halide emulsion grains preferably ranges from 0.1 to 2 μm in terms of the number average of diameters of circles having the same area of the projected grain area (circle-equivalent diameter).

The grain size distribution preferably has a coefficient of variation (a quotient of the standard deviation divided by the mean grain size) of not more than 20%, still preferably not more than 15%. A so-called mono-dispersed emulsion having a coefficient of variation of not more than 10% is the most preferred. It is preferable for obtaining broad latitude to use two or more mono-dispersed emulsions in one layer or layers.

The silver halide grains may have a regular crystal form, such as a cubic form, a tetradecahedral form or an octahedral form, an irregular crystal form, such as a spherical form or a plate form, or a composite form of these crystal forms. A mixture of grains having different crystal forms may also be used. An emulsion comprising 50% or more, preferably 70% or more, still preferably 90% or more, of grains having the above-mentioned regular crystal form is suitably used in the present invention.

Additionally, an emulsion comprising tabular grains having an average aspect ratio (a circle-equivalent diameter/thickness ratio) of 5 or more, preferably 8 or more, in a proportion of more than 50% in terms of projected area is also used to advantage. Such tabular grains include those having a (111) plane or a (100) plane.

The silver chloride (or chlorobromide) grains which can be used in the present invention are prepared by known methods as described in P. Grafkides, *Chemie et Physique Photoqraphique*, Paul Montel (1967), G. F. Duffin, *Photographic Emulsion Chemistry*, Focal Press (1966), and V. L. Zelikman, et al., *Making and Coating Photographic Emulsion*, Focal Press (1964). In some detail, any of an acid process, a neutral process, and an ammonia process may be used. The mode of reaction between a soluble silver salt and a soluble halogen salt includes a single jet process, a double jet process, and a combination thereof. A so-called reverse mixing process in which silver halide grains are formed in the presence of excess silver ions may be used. A so-called controlled double jet process, a modified process of a double jet process, in which a pAg value of a liquid phase where silver halide grains are formed is maintained constant may also be employed. According to this process, a silver halide emulsion having a regular crystal form and a nearly uniform grain size can be obtained.

It is preferable to incorporate a metal ion or a complex ion thereof into the localized silver bromide phase or the other portion of the grain (hereinafter referred to as a substrate). A suitable metal ion or metal complex ion is selected from ions of metals belonging to Group VIII or IIb of the periodic table or complexes thereof, a lead ion, and a thallium ion. A metal ion selected from iridium, rhodium, iron, etc. or a complex ion thereof is chiefly used in the localized phase, while a metal ion selected from osmium, iridium, rhodium, platinum, ruthenium, palladium, cobalt, nickel, iron, etc. or a complex ion thereof is chiefly used in the substrate. The kind and/or the concentration of the metallic ion used may be varied between the localized phase and the substrate. These metallic ions may be used either individually or in combination of two or more thereof. In particular, an iron compound and an iridium compound are preferably incorporated into the silver bromide localized phase.

The metal compound providing the metallic ion is supplied to a silver halide grain formation system as dissolved in an aqueous gelatin solution (disperse medium), an aqueous halide solution, an aqueous silver salt solution, or any other aqueous solution, or it is previously incorporated into silver halide fine grains, which are dissolved in the silver halide grain formation system, and thereby incorporated into the localized phases and/or the substrate.

Incorporation of the metallic ion into emulsion grains can be effected in any stage of grain formation, i.e., before, during or immediately after grain formation, according to the place where the metallic ion should be incorporated.

The silver halide emulsions to be used in the present invention are usually subjected to chemical sensitization and spectral sensitization.

Chemical sensitization includes chalcogen sensitization (such as sulfur sensitization using a labile sulfur compound, selenium sensitization using a selenium compound or tellurium sensitization using a tellurium compound), noble metal sensitization (typically gold sensitization), reduction sensitization, and a combination thereof. Compounds which can preferably be used in chemical sensitization are described in JP-A-62-215272, page 18, lower right column to page 22, upper right column.

The effects obtained by the present invention are especially outstanding in a light-sensitive material using a gold-sensitized high silver chloride emulsion.

The emulsion to be used in the present invention is a sol-called surface latent image type emulsion which forms a latent image predominantly on the surface of emulsion grains.

For prevention of fog during preparation, preservation or photographic processing of a light-sensitive material or for stabilization of photographic properties of a light-sensitive material, various compounds or precursors thereof can be introduced into the silver halide emulsion of the present invention. Such compounds preferably include those described in JP-A-62-215272, pp. 39-72. 5-Arylamino-1,2,3,4-thiatriazole compounds, in which the aryl moiety carries at least one electron attracting group, disclosed in European Patent 447647 are also preferred for these purposes.

Spectral sensitization is conducted in order to endow a silver halide emulsion for each layer with spectral sensitivity to a desired wavelength region.

Spectral sensitizing dyes which can be used in the present invention for spectral sensitization in the blue, green or red regions are described in F. M. Harmer, *Heterocyclic Compounds-Cyanine Dyes and Related Compounds*, John Wiley & Sons, New York and London (1964). Specific examples of these dyes and the details for sensitizing methods are described in JP-A-62-215272, page 22, upper right column to page 38. In particular, the spectral sensitizing dyes described in JP-A-3-123340 are much preferred for red sensitization of silver halide grains having a high silver chloride content for their stability, adsorbability, and small temperature dependence of exposure.

For spectral sensitization in the infrared region, the sensitizing dyes described in JP-A-3-15049 (page 12, upper left column to page 21, lower left column), JP-A-3-20730 (page 4, lower left column to page 15, lower left column), European Patent 420011 (page 4, line 21 to page 6, line 54), European Patent 420012 (page 4, line 12 to page 10, line 33), European Patent 443466, and U.S. Pat. No. 4,975,362 are preferably used.

The spectral sensitizing dye can be incorporated into a silver halide emulsion either by directly dispersing it in the emulsion or after once dissolved in a solvent, e.g., water, methanol, ethanol, propanol, methyl cellosolve, 2,2,3,3-tetrafluoropropanol or a mixture thereof. The sensitizing dye to be added to the emulsion may be formulated into an aqueous solution in the presence of an acid or a base as described in JP-B-44-23389 (the term "JP-B" as used herein means an "examined published Japanese patent application"), JP-B-44-27555 and JP-B-57-22089 or into an aqueous solution or a colloidal solution in the presence of a surface active agent as taught in U.S. Pat. Nos. 3,822,135 and 4,006,025. The aqueous solution or colloidal dispersion of the dye may be prepared by once dissolving the dye in a substantially water-immiscible solvent, such as phenoxyethanol. The dye may be directly dispersed in a hydrophilic colloid and the resulting dispersion is added to the emulsion, as disclosed in JP-A-53-102733 and JP-A-58-105141. The sensitizing dye may be added to an emulsion at any of the stages that have been received to be effective. That is, it may be added before or during grain formation, at a stage immediately after grain formation and before a washing step, before or during chemical sensitization, at a stage immediately after chemical sensitization up to cooling for solidification, or at the time of preparing a coating composition. Most commonly, it is added at a stage after completion of chemical sensitization and before coating. The sensitizing dye may be added simultaneously with a chemical sensitizer to conduct spectral sensitization and chemical sensitization simultaneously, as proposed in U.S. Pat. Nos. 3,628,969 and 4,225,666, or the dye may be added prior to chemical sensitization as described in JP-A-58-113928. The dye may be added before completion of grain deposition to initiate spectral sensitization. The sensitizing dye may be added in divided portions, that is, part of the dye is added prior to chemical sensitization, and the rest is added after chemical sensitization, as taught in U.S. Pat. No. 4,225,666. The method of addition described in U.S. Pat. No. 4,183,756 is also employable. Among these various modes of addition of spectral sensitizing dyes, addition before washing of the emulsion or before chemical sensitization is recommended.

The amount of the spectral sensitizing dye to be used ranges broadly and is usually from $0.5\times10^{-6}$ mol to $1.0\times10^{-2}$ mol, preferably from $1.0\times10^{-6}$ mol to $5.0\times10^{-3}$ mol, per mole of silver halide.

Where a sensitizing dye having spectral sensitivity in the red to infrared region is employed in the present invention, the compound described in JP-A-2-157749, page 13, lower right column to page 22, lower right column is preferably used in combination with the dye. The compound is specifically effective to improve preservability of the light-sensitive material and processing stability and to enhance the supersensitizing effect. Among the compounds disclosed, a combined use of the compound represented by formula (IV), (V) or (VI) shows particular effects. The compound is preferably used in an amount of from $0.5\times10^{-5}$ to $5.0\times10^{-2}$ mol, still preferably from $5.0\times10^{-5}$ to $5.0\times10^{-3}$ mol, per mol of silver halide. The effective amount of the compound corresponds to 0.1 to 10000 times, preferably 0.5 to 5000 times, the mole of the sensitizing dye used in combination.

The light-sensitive materials according to the present invention are suited to not only a printing system using a general negative-positive printer but to a digital scanning exposure system using a monochromatic high-density light source, e.g., a gas laser, a light emission diode (LED), a semiconductor laser, and a second harmonic generator (SHG) composed of a nonlinear optical crystal and a semiconductor laser or a solid laser using a semiconductor laser as an exciting light source. For making the system compact and inexpensive, a semiconductor laser or an SHG composed of a semiconductor laser or a solid laser and a nonlinear optical crystal is preferably used as a light source. In particular, use of a semiconductor laser is beneficial for designing compact, inexpensive, long-lasting, and high safety equipment, and it is recommended to use a semiconductor laser as at least one of exposure light sources.

When in using the above-mentioned light sources for scanning exposure, the spectral sensitivity maximum of the light-sensitive material can be set arbitrarily in agreement with the wavelength of the selected light source. In the case of an SHG light source composed of a solid laser using a semiconductor laser as an exciting light source or a semiconductor laser combined with a nonlinear optical crystal, the oscillation wavelength of the laser light is reduced by half thereby to provide blue light and green light. Therefore, it is possible for a light-sensitive material to have its spectral sensitivitymaximum in the common three regions, i.e., blue, green and red regions. In order to allow use of a semiconductor laser for making an aligner inexpensive, stable and compact, it is preferable that at least two layers of the light-sensitive material to be applied to the aligner should have their spectral sensitivity maximum at a wavelength of 670 nm or longer. This is because the state-of-the-art Group III–V semiconductor lasers which are stable and easily available at a low price have their emission wavelength region only in the red to infrared region. In laboratories, however, oscillation of a Group II–VI semiconductor laser in the green or blue region has been confirmed, and it is fairly expected that such a semiconductor laser could be supplied stably at a low price with the future development of production technology of semiconductor lasers. This being the case, the requirement for at least two layers to have their spectral sensitivity maximum at 670 nm or longer would be lessened.

According to the above-described scanning exposure system, the term "exposure time" is the time required for exposing a certain micro-area. The minimum unit for controlling quantity of light according to the respective digital data, called a pixel, is generally used as the microarea. Therefore, an exposure time per pixel varies with the size of the pixel. The size of, the pixel depends on a pixel density, and the practical pixel density ranges from 50 to 2000 dpi. Defining an exposure time to be a time for exposing a pixel size at a pixel density of 400 dpi, a preferred exposure time is not more than $10^{-4}$ second, still preferably not more than $10^{-6}$ second.

The support which can be used in the present invention is a reflective support. A reflective support which can preferably be used in the present invention is such a support that has increased reflectivity to make the dye image formed in the silver halide emulsion layers thereon clearer. Such a reflective support includes a support coated with a hydrophobic resin having dispersed therein a reflective substance, such as titanium oxide, zinc oxide, calcium carbonate or calcium sulfate, and a support made of a hydrophobic resin having dispersed therein the aforesaid reflective substance. Examples of suitable reflective supports are baryta paper, polyethylene-coated paper, polyester-coated paper, polypropylene synthetic paper, and a transparent support having a reflective layer or containing a reflective substance, such as a glass plate, a polyester film (e.g., polyethylene terephthalate, cellulose triacetate or cellulose nitrate), a polyamide film, a polycarbonate film, polystyrene film or a polyvinyl chloride film.

A preferred embodiment of the reflective support to be used in the present invention is a paper support coated on both sides thereof with a water-resistant resin, such as a polyolefin resin or a polyester resin, at least one water-resistant resin layer containing fine particles of a white pigment. The packing density of the white pigment fine particles in the water-resistant resin layer is preferably not less than 12% by weight, still preferably not less than 14% by weight, and most preferably not less than 20% by weight based on materials contained in the resin layer (laminated layer). The reflective white pigment particles are thoroughly kneaded with a water-resistant resin in the presence of a surface active agent. Pigment particles having been previously surface-treated with a di- to tetrahydric alcohol are preferably used. The water-resistant resin layer containing the white pigment particles does not need to have a uniform pigment concentration. That is, two or three water-resistant resin layers may be provided with its pigment concentration increasing toward the emulsion layer side so that the total requisite amount of the white pigment may be reduced. Taking productivity into consideration, it is preferable that the middle of three or more water-resistant resin layers has an increased white pigment concentration, while the uppermost layer (the closest to the emulsion layer) has a reduced white pigment concentration thereby to reduce the total reflective layer thickness.

It is preferable that the white pigment fine particles in a reflective layer are uniformly dispersed without forming agglomerates. The distribution of the particles can be obtained by measuring the projected area ratio of the particles per unit area (Ri; %). The coefficient of variation of the area ratio (%) can be obtained from a ratio of a standard deviation (s) of Ri to a mean value (R) of Ri, i.e., s/R. In the present invention, the coefficient of variation of the area ratio (%) of the pigment fine particles is preferably not more than 0.15, still preferably not more than 0.12, and most preferably not more than 0.08.

In addition to the above-described reflective supports, a support with a metallic surface showing regular reflection or diffused reflection of the second kind can also be used as a reflective support. A metallic surface having a spectral reflectance of not less than 0.5 in the visible light region is preferred. The metallic surface is made to have diffused reflection suitably by surface graining or using a powdered metal. The metal includes aluminum, tin, silver, magnesium, and an alloy of these metals. The metallic surface may be a metallic plate, foil or film formed by rolling, vacuum evaporation, plating, and the like. In particular, a support composed of a substrate having thereon a metal layer formed by vacuum evaporation is preferred. On the metallic surface is preferably provided a water-resistant resin layer, especially a thermoplastic resin layer. On the other side of the support is preferably provided an antistatic layer. For the details of the support of this kind, refer to, e.g., JP-A-61-210346, JP-A-63-24247, JP-A-63-24251, and JP-A-63-24255. The terminology "diffused reflection of the second kind" as used above means such diffused reflection as obtained by providing unevenness to a mirror surface to divide it into fine areas with a mirror surface facing to different directions thereby to disperse the facing direction of the fine areas (mirror surfaces). The unevenness of the surface showing diffused reflection of the second kind has a three-dimensional centerline average surface roughness of from 0.1 to 2 μm, preferably from 0.1 to 1.2 μm. The frequency of the surface unevenness having a surface roughness of 0.1 μm or greater is preferably 0.1 to 2000 cycles/mm, still preferably 50 to 600 cycles/mm. The details of such a support are described in JP-A-2-239244.

Gelatin is advantageously used as a binder or protective colloid of the emulsion layer. Other hydrophilic colloids may also be used alone or in combination with gelatin. Gelatin to be used includes lime-processed gelatin and acid-processed gelatin. The details for preparation of gelatin are described in Arther Vice, *The Macromolecular Chemistry of Gelatin*, Academic Press (1964).

Gelatin having a calcium content of not more than 800 ppm, particularly not more than 200 ppm, is preferred. An antifungal agent as described in JP-A-63-271247 is preferably added to gelatin to prevent image deterioration caused by proliferation of mold or bacteria in hydrophilic colloidal layers.

When the light-sensitive material of the present invention is exposed to light using a printer, the band stop filter described in U.S. Pat. No. 4,880,726 is preferably used. It is effective to remove light color mixing and to improve color reproducibility remarkably.

After exposure, the light-sensitive material is subjected to conventional color development processing. For the purpose of rapid processing, color development is preferably followed by bleach-fixing. Where the aforesaid high silver chloride emulsion is used, the bleach-fixing bath preferably has a pH of not higher than about 6.5, still preferably not higher than about 6, for the purpose of desilvering acceleration.

In a preferable method for forming a color image of the present invention, the silver halide color light-sensitive material is exposed in a scanning exposure system for an exposure time of not more than $10^{-4}$ second per pixel and subjected to color development processing.

Further, in a preferable method for forming a color image of the present invention, the silver halide color light-sensitive material is exposed and processed within a total processing time of 120 seconds from color development through drying, with the time of color development being within 25 seconds.

Materials and methods suitably applicable to the light-sensitive material of the present invention are described in JP-A-62-215272, JP-A-2-33144, and EP-A2-355660 (corresponding to JP-A-2-139544), particularly the third one, as tabulated below. In the following table, abbreviation U(or L)R(or L) stands for upper(or lower) right column (or left column); p is page, and 1 is line.

| | JP-A-62-215272* | JP-A-2-33144 | EP-A2-355660 |
|---|---|---|---|
| Silver halide emulsion | p. 10, UR, 1. 6 to p. 12, LL, 1. 5 and p. 12, LR, 1. 4 from the bottom to p. 13, UL, 1. 17 | p. 28, UR, 1. 16 to p. 29, LR, 1. 11 and p. 30, 11. 2–5 | p. 45, 1. 53 to p. 47, 1. 3 and p. 47, 11. 20–22 |
| Silver halide solvent | p. 12, LL, 11. 6–14 and p. 13, UL, 1. 3 from the bottom to p. 18, LL, the last line | — | — |
| Chemical sensitizer | p. 12, LL, 1. 3 from the the bottom to LR, 1. 5 from the bottom and p. 18, LR, 1. 1 to p. 22, UR, 1. 9 from the bottom | p. 29, LR, 1. 12 to the last line | p. 47, 11. 4–9 |
| Spectral sensitizer (spectral sensitization) | p. 22, UR, 1. 8 from the bottom to p. 38 the last line | p. 30, UL, 11. 1–13 | p. 47, 11. 10–15 |
| Emulsion stabilizer | p. 39, UL, 1. 1 to p. 72, UR, the last line | p. 30, UL, 1. 14 to UR, 1. 1 | p. 47, 11. 16–19 |
| Development accelerator | p. 72, LL, 1. 1 to p. 91, UR, 1. 3 | — | — |
| Color coupler (cyan, magenta and yellow) | p. 91, UR, 1. 4 to p. 121, UL, 1. 6 | p. 3, UR, 1. 14 to p. 18, UL, the last line and p. 30, UR, 1. 6 to p. 35, LR, 1.11 | p. 4, 11. 15–27, p. 5, 1. 30 to p. 28, the last line, p. 45, 11. 29–31, and p. 47, 1. 23 to p. 63, 1. 50 |
| Color development enhancing agent | p. 121, UL, 1. 7 to p. 125, UR, 1. 1 | — | — |
| Ultraviolet absorbent | p. 125, UR, 1. 2 to p. 127, LL, the last line | p. 37, LR, 1. 14 to p. 38, UL, 1. 11 | p. 65, 11. 22–31 |
| Discoloration hibitor (image stabilizer) | p. 127, LR, 1. 1 to p. 137, LL, 1. 8 | p. 36, UR, 1. 12 to p. 37, UL, 1. 19 | p. 4, 1. 30 to p. 5, 1. 23, p. 29, 1. 1 to p. 45, 1. 25, p. 45, 11. 33–40, and p. 65, 11. 2–21 |
| High-boiling and/or low-boiling organic solvent | p. 137, LL, 1. 9 to p. 144, UR, the last line | p. 35, LR, 1. 14 to p. 36, UL, 1. 4 from the bottom | p. 64, 11. 1–51 |
| Method for dispersing photographic additive | p. 144, LL, 1. 1 to p. 146, UR, 1. 7 | p. 27, LR, 1. 10 to p. 28, UL, the last line and p. 35, LR, 1. 12 to p. 36, UR, 1. 7 | p. 63, 1. 51 to p. 64, 1. 56 |
| Hardening agent | p. 146, UR, 1. 8 to p. 155, LL, 1. 4 | — | — |
| Developing agent precursor | p. 155, LL, 1. 5 to p. 155, LR, 1. 2 | — | — |
| Development inhibitor-releasing compound | p. 155, LR, 11. 3–9 | — | — |
| Layer structure | p. 156, UL, 1. 15 to p. 156, LR, 1. 14 | p. 28, UR, 11. 1–15 | p. 45, 11. 41–52 |
| Dye | p. 156, LR, 1. 15 to p. 184, LR, the last line | p. 38, UL, 1. 12 to UR, 1. 7 | p. 66, 11. 18–22 |
| Color mixing inhibitor | p. 185, UL, 1. 1 to p. 188, LR, 1. 3 | p. 36, UR, 11. 8–11 | p. 64, 1. 57 to p. 65, 1. 1 |
| Gradation regulator | p. 188, LR, 11. 4–8 | — | — |
| Stain inhibitor | p. 188, LR, 1. 9 to p. 193, LR, 1. 10 | p. 37, UL, the last line to LR, 1. 13 | p. 65, 1. 32 to p. 66, 1. 17 |
| Surface active agent | p. 201, LL, 1. 1 to p. 210, UR, the last line | p. 18, UR, 1. 1 to p. 24, LR, the last line and p. 27, LL, 1. 10 from the bottom to LR, 1. 9 | — |
| F-containing compound (antistatics, coating aids, lubricants, adhesives, etc.) | p. 210, LL, 1. 1 to p. 222, LL, 1. 5 | p. 25, UL, 1. 1 to p. 27, LR, 1. 9 | — |
| Binder (hydrophilic colloid) | p. 222, LL, 1. 6 to p. 225, UL, last line | p. 38, UR, 11. 8–18 | p. 66, 11. 23–28 |
| Thickener | p. 225, UR, 1. 1 to p. 227, UR, 1. 2 | — | — |
| Antistatic agent | p. 227, UR, 1. 3 to p. 230, UL, 1. 1 | — | — |
| Polymer latex | p. 230, UL, 1. 2 to p. 239, the last line | — | — |

-continued

| | JP-A-62-215272* | JP-A-2-33144 | EP-A2-355660 |
|---|---|---|---|
| Matting agent | p. 240, UL, 1. 1 to p. 240, UR, the last line | — | — |
| Photographic processing method (steps and additives) | p. 3, UR, 1. 7 to p. 10, UR, 1. 5 | p. 39, UL, 1. 4 to p. 42, UL, the last line | p. 67, 1. 14 to p. 69, 1. 28 |

Note: The disclosure of JP-A-62-215272 includes the amendment filed on Mar., 16, 1987.

The magenta couplers shown in the above table can be used in combination with the magenta coupler of the present invention.

Incorporation of a cyan, magenta or yellow coupler into a light-sensitive material is preferably effected by impregnating a loadable latex polymer (e.g., the latex polymer described in U.S. Pat. No. 4,203,716) with a coupler in the presence or absence of the high-boiling organic solvent shown in the above table or dissolving a coupler in a water-insoluble and organic solvent-soluble polymer, and dispersing and emulsifying the polymer in an aqueous solution of a hydrophilic colloid.

Examples of suitable water-insoluble and organic solvent-soluble polymers include homopolymers and copolymers described in U.S. Pat. No. 4,857,449, Cls. 7 to 15 and WO 88/723, pp. 12–30. Methacrylate polymers or acrylamide polymers, particularly the latter, are still preferred from the standpoint of dye image stability.

The light-sensitive material of the present invention preferably contains the compound described in EP-A2-277589, which serves for improving dye image preservability, in combination with couplers. The compound disclosed is particularly effective when used in combination with pyrazoloazole couplers or pyrrolotriazole couplers. The compound disclosed chemically reacts with an aromatic amine developing agent remaining after color development or an oxidation product of an aromatic amine developing agent remaining after color development to form a chemically inert and substantially colorless compound. Therefore, use of the compound capable of reacting with a residual aromatic amine developing agent and/or the compound capable of reacting with a residual oxidation product of an aromatic amine developing agent is effective to prevent the color developing agent or an oxidation product thereof remaining in a film after processing from further reacting with couplers during preservation to cause stains or any other unfavorable side effects.

Suitable cyan couplers include, in addition to the diphenylimidazole couplers described in JP-A-2-33144, 3-hydroxypyridine couplers described in EP-A2-333185 (among them preferred are 4-equivalent coupler (42) rendered 2-equivalent by introduction of a chlorine releasable group, coupler (6), and coupler (9)), cyclic active methylene couplers described in JP-A-64-32260 (among them preferred are couples 3, 8, and 34), pyrrolopyrazole couplers described in EP-A1-456226, pyrroloimidazole couplers described in European Patent 484909, and pyrrolotriazole couplers described in European Patent 488248 and EP-A1-491197. Particularly preferred of these cyan couplers are pyrrolotriazole couplers.

Suitable yellow couplers include, in addition to those referred to in the above table, acylacetamide couplers having a 3- to 5-membered cyclic structure in the acyl group as disclosed in EP-A1-447969; malondianilide couplers having a cyclic structure as described in EP-A1-482552; and acylacetamide couplers having a dioxane structure as described in U.S. Pat. No. 5,118,599. Particularly preferred of them are acylacetamide couplers having a 1-alkylcyclopropane-1-carbonyl group as an acyl group and malondianilide couplers one anilide moiety of which constitutes an indoline ring. These yellow couplers may be used either individually or in combination thereof.

Suitable methods for processing the color light-sensitive material of the present invention and suitable additives used therein are described in, in addition to the above-cited publications, JP-A-2-207250, page 26, lower right column, line 1 to page 34, upper right column, line 9 and JP-A-4-97355, page 5, upper left column, line 17 to page 18, lower right column, line 20.

The present invention will now be illustrated in greater detail with reference to Examples, but it should be understood that the present invention is not construed as being limited thereto. All the percents are by weight unless otherwise indicated.

EXAMPLE 1

Preparation of Supports

Low-density polyethylene having a melt flow rate (MFR) of 3 was mixed with 30% of titanium dioxide based on the polyethylene and 3.0%, based on titanium dioxide, of zinc stearate, and kneaded for extrusion with ultramarine DV-1, produced by Dai-ichi Kasei Kogyo K. K., in a Banbury mixer. The titanium dioxide used here had a particle size of 0.15 to 0.35 μm under an electron microscope and had a hydrated aluminum oxide coat in an amount of 0.75%, in terms of $Al_2O_3$, based on titanium dioxide.

A paper substrate having a basis weight of 170 g/m$^2$ was subjected to a corona treatment at 10 kVA, and the above-prepared polyethylene composition having a titanium dioxide content of 30% and a separately prepared polyethylene composition containing ultramarine but no titanium dioxide were melt-extruded at 320° C. using a multilayer extrusion coating die to form a polyethylene laminate layer composed of a 18 μm thick upper layer (titanium dioxide content: 30%) and a 15 μm thick lower layer (titanium dioxide content: 0%) on the paper substrate. The surface of the polyethylene layer was then subjected to a glow discharge treatment.

Preparation of Light-Sensitive Material (Sample 101)

The above-prepared reflective support was coated with various photographic layers to prepare multilayer color paper having the following layer structure. The resulting color paper was designated sample 101. Coating compositions were prepared as follows.

Preparation of Coating Composition for Third Layer

In a mixed solvent consisting of 32.5 g of Solv-3, 97.5 g of Solv-4, 65.0 g of Solv-6, and 110 cc of ethyl acetate were dissolved 40.0 g of magenta coupler ExM, 40.0 g of ultraviolet absorbent UV-2, 7.5 g of dye image stabilizer Cpd-2, 25.0 g of dye image stabilizer Cpd-5, 2.5 g of dye image stabilizer Cpd-6, 20.0 g of dye image stabilizer Cpd-7, 2.5 g of dye image stabilizer Cpd-8, and 5.0 g of dye image stabilizer Cpd-10. The solution was dispersed in 1500 g of a 7% aqueous gelatin solution containing 90 cc of 10% sodium dodecylbenzenesulfonate to prepare coupler dispersion A.

Separately, a cubic silver chlorobromide emulsion having a mean grain size of 0.55 μm with a coefficient of variation of 0.08 and a cubic silver chlorobromide emulsion having a mean grain size of 0.39 μm with a coefficient of variation of 0.06 were mixed at a silver molar ratio of 1:3 to prepare silver chlorobromide emulsion B-1. An emulsion having a larger grain size will hereinafter be referred to as a larger size emulsion, while an emulsion having a smaller grain size will hereinafter be referred to as a smaller size emulsion. Both the larger size emulsion grains and the smaller size emulsion grains used above were composed of silver chloride substrate grains having 0.8 mol % of silver bromide localized on part of their surface and contained, in both the inside thereof and the localized silver bromide phase thereof, potassium hexachloroiridate (IV) in a total amount of 0.1 mg and potassium ferrocyanide in a total amount of 1.0 mg. The larger size emulsion and the smaller size emulsion each had been spectrally sensitized with green sensitizing dyes D, E, and F, used in an amount of $3.0\times10^{-4}$ mol, $4.0\times10^{-5}$ mol, and $2.0\times10^{-4}$ mol, respectively, per mole of silver for the former emulsion, and $3.6\times10^{-4}$ mol, $7.0\times10^{-5}$ mol, and $2.8\times10^{-4}$ mol, respectively, per mole of silver for the latter emulsion. Each spectrally sensitized emulsion was then subjected to optimum chemical sensitization using a sulfur sensitizer and a gold sensitizer in the presence of a nucleic acid decomposition product.

Coupler dispersion A and silver chlorobromide emulsion B-1 were mixed and dissolved to obtain a coating composition for the third layer.

Coating compositions for the other light-sensitive layers (first to seventh layers) were prepared in the same manner as described above.

Sodium 1-oxy-3,5-dichloro-s-triazine was used as a gelatin hardening agent in each gelatin layer.

In addition, antiseptics Cpd-12 and Cpd-13 were added to every layer to provide a total content of 25.0 mg/m$^2$ and 50.0 mg/m$^2$, respectively.

The silver chlorobromide emulsion used in each light-sensitive emulsion layer was prepared in the same manner as for emulsion B-1 while appropriately adjusting the grain size of the larger size emulsion and the smaller size emulsion. The spectral sensitizers used for the silver chlorobromide emulsions are shown below.

For Blue-Sensitive Emulsion Layer

Each of sensitizing dyes A, B, and C shown below was used in an amount of $1.4\times10^{-4}$ mol/mol-AgX (AgX represents silver halide, hereinafter the same) for a larger size emulsion and $1.7\times10^{-4}$ mol/mol-AgX for a smaller size emulsion.

Sensitizing Dye A:

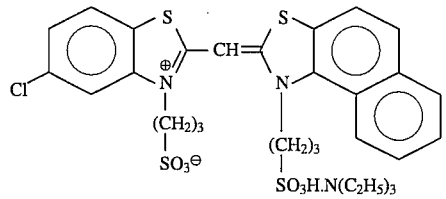

Sensitizing Dye B:

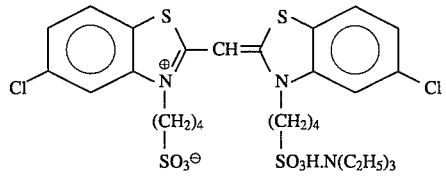

Sensitizing Dye C:

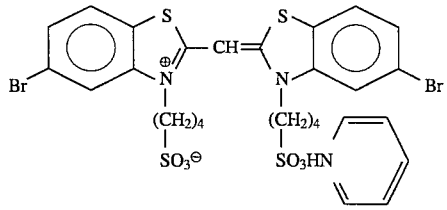

For Green-Sensitive Emulsion Layer

Dye D was used in an amount of $3.0\times10^{-4}$ mol/mol-AgX for a larger size emulsion and $3.6\times10^{-4}$ mol/mol-AgX for a smaller size emulsion; Dye E was used in an amount of $4.0\times10^{-5}$ mol/mol-AgX for a larger size emulsion and $7.0\times10^{-5}$ mol/mol-AgX for a smaller size emulsion; and Dye F was used in an amount of $2.0\times10^{-4}$ mol/mol-AgX for a larger size emulsion and $2.8\times10^{-4}$ mol/mol-AgX for a smaller size emulsion.

Sensitizing Dye D:

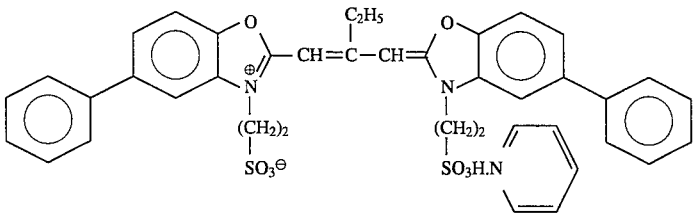

Sensitizing Dye E:

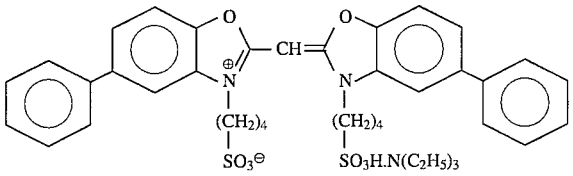

Sensitizing Dye F:

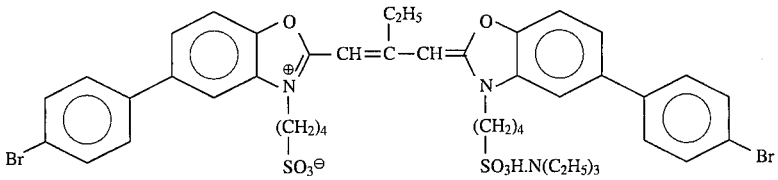

For Red-Sensitive Emulsion Layer

Dye G was used in an amount of $4.0\times10^{-5}$ mol/mol-AgX for a larger size emulsion and $5.0\times10^{-5}$ mol/mol-AgX for a smaller size emulsion; and Dye H was used in an amount of $5.0\times10^{-5}$ mol/mol-AgX for a larger size emulsion and $6.0\times10^{-5}$ mol/mol-AgX for a smaller size emulsion.

Sensitizing Dye G:

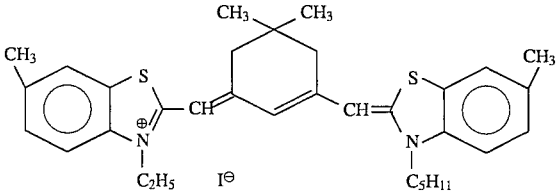

Sensitizing Dye H:

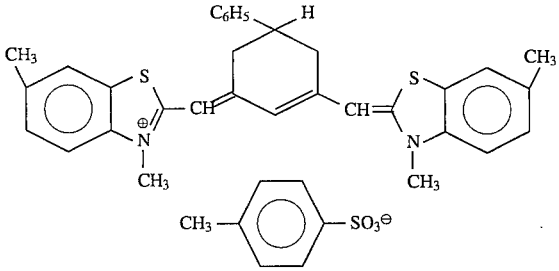

The red-sensitive silver halide emulsion layer further contained $2.6\times10^{-3}$ mol/mol-AgX of a compound of formula:

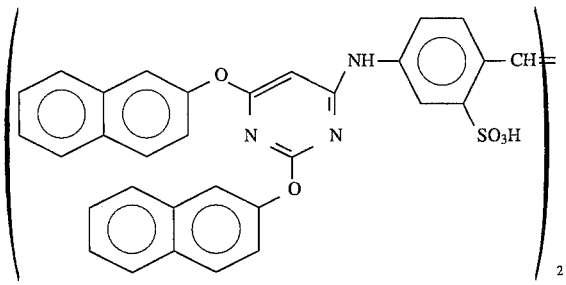

The blue-sensitive emulsion layer, green-sensitive emulsion layer, and red-sensitive emulsion layer further contained $8.5\times10^{-4}$ mol, $3.0\times10^{-3}$ mol and $2.5\times10^{-4}$ mol, respectively, per mole of AgX, of 1-(5-methylureidophenyl)-5-mercaptotetrazole.

The blue-sensitive emulsion layer and green-sensitive emulsion layer contained $1\times10^{-4}$ mol and $2\times10^{-4}$ mol, respectively, per mole of AgX, of 4-hydroxy-6-methyl-1,3,3a,7-tetraazaindene.

Layer Structure

The layer structure of sample 101 is shown below. The figure for each component is the coating weight (unit: g/m$^2$), provided that the coating weight of a silver halide emulsion is expressed in terms of gram of silver per m$^2$ Support (A)

The above-described support composed of a paper substrate having on the coated side thereof a polyethylene laminate layer containing a bluing dye (ultramarine).

| | |
|---|---|
| First Layer (Blue-Sensitive Emulsion Layer): | |
| Cubic silver chlorobromide emulsion A-1 [A 5:5 (by Ag mole) mixture of a larger size emulsion (mean grain size: 0.88 μm; size distribution coefficient of variation: 0.08) and a smaller size emulsion (mean grain size: 0.70 μm; size distribution coefficient of variation: 0.10), both composed of silver chloride substrate grains having 0. 3 mol % of silver bromide localized on part of their surface; total potassium hexachloroiridate (IV) content in both the inside and silver bromide localized phase: 0.1 mg/mol-Ag; total potassium ferrocyanide content in the inside and silver bromide localized phase: 1.0 mg/mol-Ag] | 0.27 |
| Gelatin | 1.22 |
| Yellow coupler ExY | 0.79 |
| Dye image stabilizer Cpd-1 | 0.08 |
| Dye image stabilizer Cpd-2 | 0.04 |
| Dye image stabilizer Cpd-3 | 0.08 |
| Dye image stabilizer Cpd-5 | 0.01 |
| Solvent Solv-1 | 0.13 |
| Solvent Solv-5 | 0.13 |
| Second Layer (Color Mixing Preventing Layer): | |
| Gelatin | 0.90 |
| Color mixing inhibitor Cpd-4 | 0.08 |
| Solvent Solv-1 | 0.10 |
| Solvent Solv-2 | 0.15 |
| Solvent Solv-3 | 0.25 |
| Solvent Solv-8 | 0.03 |
| Third Layer (Green-Sensitive Emulsion Layer): | |
| Silver chlorobromide emulsion B-1 | 0.13 |
| Gelatin | 1.45 |
| Magenta coupler ExM | 0.16 |
| Ultraviolet absorbent UV-2 | 0.16 |
| Dye image stabilizer Cpd-2 | 0.03 |
| Dye image stabilizer Cpd-5 | 0.10 |
| Dye image stabilizer Cpd-6 | 0.01 |
| Dye image stabilizer Cpd-7 | 0.08 |

-continued

| | |
|---|---|
| Dye image stabilizer Cpd-8 | 0.01 |
| Dye image stabilizer Cpd-10 | 0.02 |
| Solvent Solv-3 | 0.13 |
| Solvent Solv-4 | 0.39 |
| Solvent Solv-6 | 0.26 |
| Fourth Layer (Color Mixing Preventing Layer): | |
| Gelatin | 0.68 |
| Color mixing inhibitor Cpd-4 | 0.06 |
| Solvent Solv-1 | 0.07 |
| Solvent Solv-2 | 0.11 |
| Solvent Solv-3 | 0.18 |
| Solvent Solv-8 | 0.02 |
| Fifth Layer (Red-Sensitive Emulsion Layer): | |
| Cubic silver chlorobromide emulsion C-1 [1:4 (by Ag mole) mixture of a larger size emulsion (mean grain size: 0.50 μm; size distribution coefficient of variation: 0.09) and a smaller size emulsion (mean grain size: 0.41 μm; size distribution coefficient of variation: 0.11), both composed of silver chloride substrate grains having 0.8 mol % of silver bromide localized on part of their surface; total potassium hexachloroiridate (IV) content in the inside and silver bromide localized phase: 0.3 mg/mol-Ag; total potassium ferrocyanide content in the inside and silver bromide localized phase: 1.5 mg/mol-Ag] | 0.18 |
| Gelatin | 0.80 |
| Cyan coupler ExC | 0.33 |
| Ultraviolet absorbent UV-2 | 0.18 |
| Dye image stabilizer Cpd-1 | 0.33 |
| Dye image stabilizer Cpd-2 | 0.03 |
| Dye image stabilizer Cpd-6 | 0.01 |
| Dye image stabilizer Cpd-8 | 0.01 |
| Dye image stabilizer Cpd-9 | 0.02 |
| Dye image stabilizer Cpd-10 | 0.01 |
| Solvent Solv-1 | 0.01 |
| Solvent Solv-7 | 0.22 |
| Sixth Layer (Ultraviolet Absorbing Layer): | |
| Gelatin | 0.48 |
| Ultraviolet absorbent UV-1 | 0.38 |
| Dye image stabilizer Cpd-5 | 0.01 |
| Dye image stabilizer Cpd-7 | 0.05 |
| Solvent Solv-9 | 0.05 |
| Seventh Layer (Protective Layer): | |
| Gelatin | 0.90 |
| Acryl-modified polyvinyl alcohol (degree of modification: 17%) | 0.05 |
| Liquid paraffin | 0.02 |
| Dye image stabilizer Cpd-11 | 0.01 |

Yellow Coupler ExY:

A 1:1 mixture (by mole) of a compound of formula:

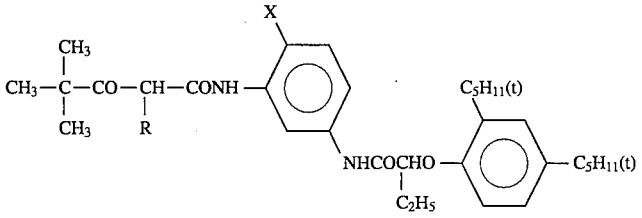

wherein R is

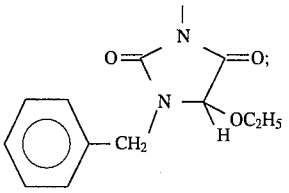

and X is Cl and a compound of the above formula: wherein R is

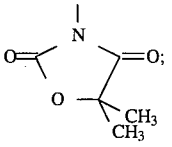

and X is $OCH_3$.

Magenta Coupler ExM:

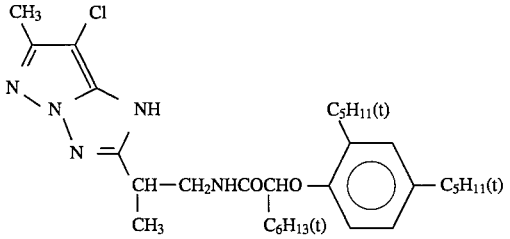

Cyan Coupler ExC:

A 25:75 mixture (by mole) of

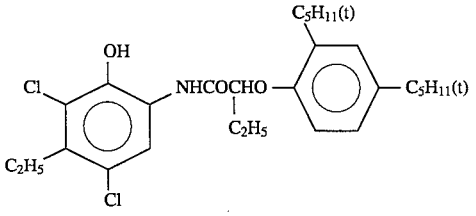

and

-continued

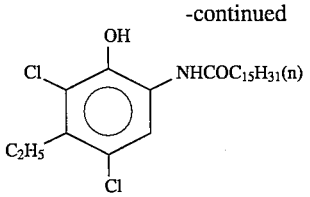

Dye Image Stabilizer Cpd-1:

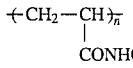

(Number average molecular weight: 60,000)

Dye Image Stabilizer Cpd-2:

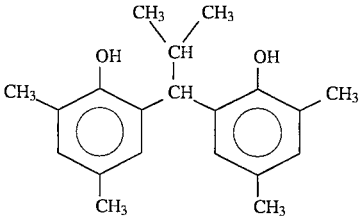

Dye Image Stabilizer Cpd-3:

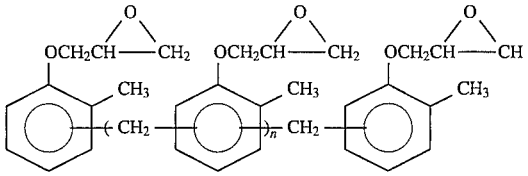

n: 7 to 8 (mean value)

Color Mixing Inhibitor Cpd-4:

A 1:1:1 mixture (by weight) of (i)

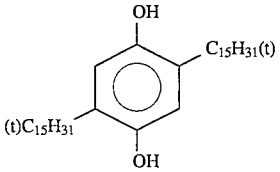

(ii)

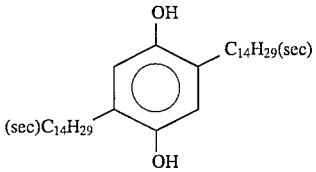

and (iii)

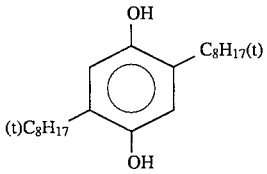

Dye Image Stabilizer Cpd-5:

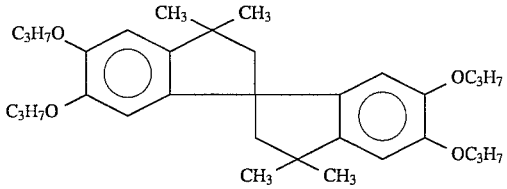

Dye Image Stabilizer Cpd-6:

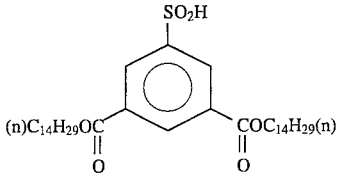

Dye Image Stabilizer Cpd-7:

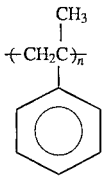

(Number average molecular weight: 600)

Dye Image Stabilizer Cpd-8:

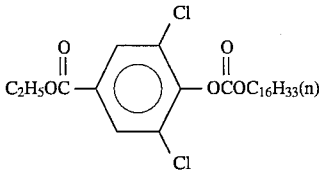

Dye Image Stabilizer Cpd-9:

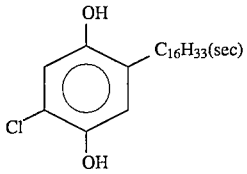

Dye Image Stabilizer Cpd-10:

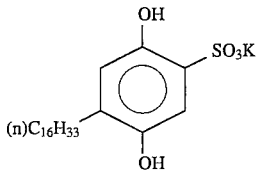

Cpd-11:

A 1:2:1 mixture (by weight) of i)

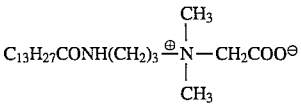

ii)

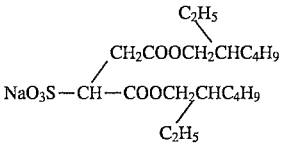

and iii)

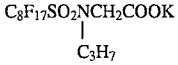

Antiseptic Cpd-12:
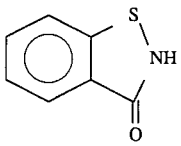
Antiseptic Cpd-13:
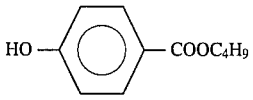
Ultraviolet Absorbent UV-1:
A 1:2:2:3:1 mixture (by weight) of
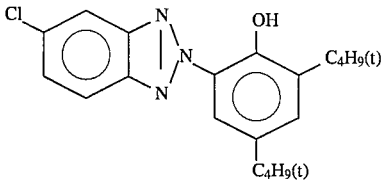
(iv)
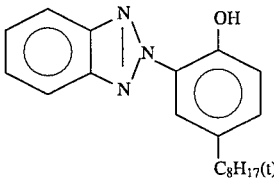
(v)
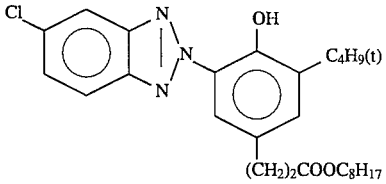
(vi)
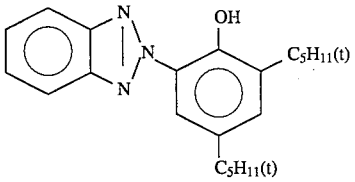
(vii)
and
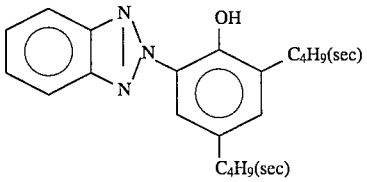
(viii)
Ultraviolet Absorbent UV-2:
A 2:3:4:1 mixture (by weight) of
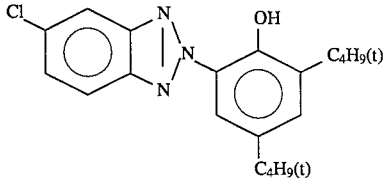
(ix)
-continued
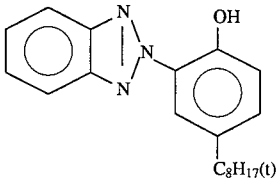
(x)
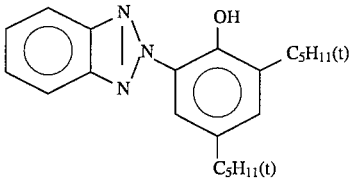
(xi)
and
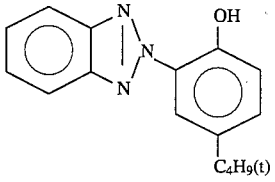
(xii)
Solvent Solv-1:
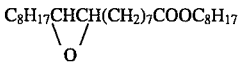
Solvent Solv-2:
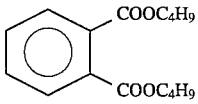
Solvent Solv-3:
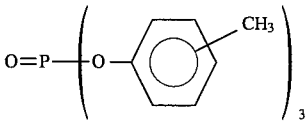
Solvent Solv-4:
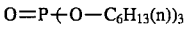
Solvent Solv-5:
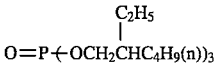
Solvent Solv-6:
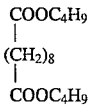

Solvent Solv-7:

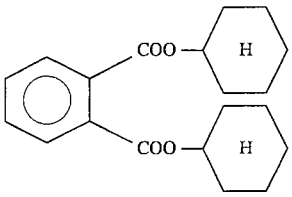

Solvent Solv-8:

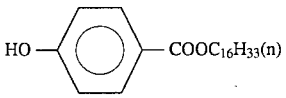

Solvent Solv-9:

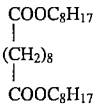

Preparation of Samples 102 to 128:

Samples 102 to 128 were prepared in the same manner as for sample 101, except that magenta coupler ExM in the third layer was replaced with an equimolar amount of the magenta coupler shown in Table 1 below and that the second and fourth layers further contained the dye shown in Table 1. The dye added to the second and fourth layers diffused to all the other layers almost uniformly upon application.

TABLE 1

| Sample No. | Magenta Coupler | Dye Added to 2nd & 4th Layers: Kind | Dye Added to 2nd & 4th Layers: Amount* (mol/m$^2$) | Reflection Density (550 nm) | Remark |
|---|---|---|---|---|---|
| 101 | ExM | — | — | — | Comparison |
| 102 | " | Dye A | $5 \times 10^{-6}$ | 0.2 | " |
| 103 | " | " | $1 \times 10^{-5}$ | 0.4 | " |
| 104 | " | " | $2.5 \times 10^{-5}$ | 0.6 | " |
| 105 | " | 11 | $1 \times 10^{-5}$ | 0.4 | " |
| 106 | " | " | $2.5 \times 10^{-5}$ | 0.6 | " |
| 107 | " | 20 | " | 0.55 | " |
| 108 | compar. magenta coupler A | — | — | — | Comparison |
| 109 | compar. magenta coupler A | Dye A | $5 \times 10^{-6}$ | 0.2 | " |
| 110 | compar. magenta coupler A | " | $1 \times 10^{-5}$ | 0.4 | " |
| 111 | compar. magenta coupler A | " | $2.5 \times 10^{-5}$ | 0.6 | " |
| 112 | compar. magenta coupler A | 11 | $1 \times 10^{-5}$ | 0.4 | " |
| 113 | compar. magenta coupler A | " | $2.5 \times 10^{-5}$ | 0.6 | " |
| 114 | compar. magenta coupler A | 20 | " | 0.55 | " |
| 115 | M-1 | — | — | — | Comparison |
| 116 | " | Dye A | $5 \times 10^{-6}$ | 0.2 | " |
| 117 | " | " | $1 \times 10^{-5}$ | 0.4 | Invention |
| 118 | " | " | $2.5 \times 10^{-5}$ | 0.6 | " |
| 119 | " | 11 | $1 \times 10^{-5}$ | 0.4 | " |
| 120 | " | " | $2.5 \times 10^{-5}$ | 0.6 | " |
| 121 | M-1 | 20 | $2.5 \times 10^{-5}$ | 0.55 | Invention |
| 122 | M-7 | — | — | — | Comparison |
| 123 | " | Dye A | $5 \times 10^{-6}$ | 0.2 | " |
| 124 | " | " | $1 \times 10^{-5}$ | 0.4 | Invention |
| 125 | " | " | $2.5 \times 10^{-5}$ | 0.6 | " |
| 126 | " | 11 | $1 \times 10^{-5}$ | 0.4 | " |
| 127 | " | " | $2.5 \times 10^{-5}$ | 0.6 | " |
| 128 | " | 20 | " | 0.55 | " |

Note: *The total amount in the 2nd and 4th layers.

Comparative Magenta Coupler A:

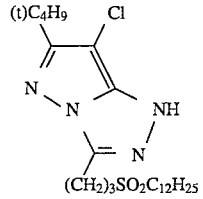

Dye A:

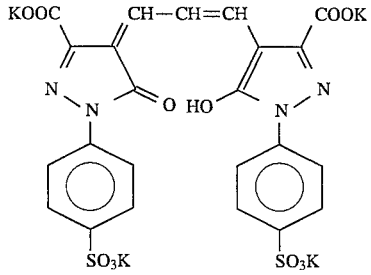

After gelatin hardening, each sample, composed of 25% of fogged film exposed to white light and 75% of unexposed film, was continuously processed using the respective processing solutions according to the following schedule (running test).

| Processing Step | Temp. (°C.) | Time (sec) | Rate of Replenishment (ml/m$^2$) | Volume of Tank (ml) |
|---|---|---|---|---|
| Color development | 38.5 | 45 | 73 | 500 |
| Bleach-fix | 30–35 | 45 | | |
| Rinsing (1) | 30–35 | 20 | | |
| Rinsing (2) | 30–35 | 20 | | |
| Rinsing (3) | 30–35 | 20 | | |
| Drying | 70–80 | 60 | | |

The rinsing was carried out in a counter-flow system of three tanks from (3) toward (1).

Each processing solution had the following formulation.

Color Developer:

| | Running Solution | Replenisher |
|---|---|---|
| Water | 700 ml | 700 ml |
| Sodium triisopropylene(β)sulfonate | 0.1 g | 0.1 g |
| Ethylenediaminetetraacetic acid | 3.0 g | 3.0 g |
| Disodium 1,2-dihydroxybenzene-4,6-disulfonate | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |
| Fluorescent brightening agent WHITEX 4, produced by Sumitomo Chemical Co., Ltd. | 1.0 g | 3.0 g |
| Sodium sulfite | 0.1 g | 0.1 g |
| Disodium N,N-bis(sulfonatoethyl)-hydroxylamine | 10.0 g | 13.0 g |
| N-Ethyl-N-(β-methanesulfonamido-ethyl)-3-methyl-4-aminoaniline sulfate | 5.0 g | 11.5 g |
| Water to make | 1000 ml | 1000 ml |
| pH (25° C.) | 10.0 | 11.0 |

Bleach-Fixing Solution:

The running solution and the replenisher had the same formulation.

| | |
|---|---|
| Water | 600 ml |
| Ammonium thiosulfate (700 g/l) | 100 ml |
| Ammonium sulfite | 40 g |
| Ammonium (ethylenediaminetetraacetato)iron (III) | 55 g |
| Disodium ethylenediaminetetraacetate | 5 g |
| Ammonium bromide | 40 g |
| Nitric acid (67%) | 30 g |
| Water to make | 1000 ml |
| pH (25° C.) (adjusted with acetic acid and aqueous ammonia) | 5.8 |

Rinsing Solution:

Ion-exchanged water having calcium and magnesium ion concentration each reduced to 3 ppm or less was used as both a running solution and a replenisher.

Sensitometry

Before and after the running test, each of samples 101 to 128 was exposed to light through a color separation filter and a discontinuous wedge using a sensitometer (Model FWH, manufactured by Fuji Photo Film Co., Ltd.; color temperature of a light source: 3200° K.) and processed with the respective processing solutions.

The magenta density D(magenta) of the sample processed with the fatigued developer (Run) after the running test, at the exposure which provided a magenta density of 2.0 when the sample was processed with the fresh developer (Fr) before the running test, was measured to obtain the density change [(ΔD(Run-Fr)=D(magenta)−2.0]. The greater the density change (negative), the greater the processing dependence. The results obtained are shown in Table 2.

Evaluation of Sharpness

Each sample was contact exposed through an optical wedge having a square pattern of various frequency to light via a green filter (maximum wavelength of transmitted light: 550 nm) using a sensitometer manufactured by Fuji Photo Film Co., Ltd. to obtain resolution in magenta development. The frequency C (lines/mm) giving a CTF value of 0.5 was taken as an indication of resolution. The CTF value is a ratio of $\Delta D_c$ to $\Delta D_0$, in which $\Delta D_0$ is a density difference between a high density area and a low density area when a sample is exposed through an optical wedge having a zero frequency, i.e., no repetition of a square pattern, with its light quantity continuously changing from high to low over a very broad area; and $\Delta D_c$ is a density difference between a high density area and a low density area when a sample is exposed through an optical wedge having a square pattern at frequency C (lines/mm). The greater the C value, the higher the resolution. The results obtained are also shown in Table 2.

TABLE 2

| Sample No. | ΔD(Run-Fr) | C (lines/mm) | Remark |
|---|---|---|---|
| 101 | −0.02 | 9.3 | Comparison |
| 102 | −0.07 | 9.6 | " |
| 103 | −0.11 | 11.5 | " |
| 104 | −0.18 | 13.3 | " |
| 105 | −0.10 | 11.6 | " |
| 106 | −0.17 | 13.5 | " |
| 107 | −0.18 | 13.2 | " |
| 108 | −0.02 | 9.3 | Comparison |
| 109 | −0.08 | 9.5 | " |
| 110 | −0.13 | 11.4 | " |
| 111 | −0.19 | 13.2 | " |
| 112 | −0.12 | 11.5 | Comparison |
| 113 | −0.18 | 13.4 | " |
| 114 | −0.18 | 13.1 | " |
| 115 | −0.02 | 9.3 | Comparison |
| 116 | −0.04 | 9.6 | " |
| 117 | −0.05 | 11.6 | Invention |
| 118 | −0.07 | 13.4 | " |
| 119 | −0.02 | 11.7 | " |
| 120 | −0.04 | 13.6 | " |
| 121 | −0.04 | 13.2 | " |
| 122 | −0.02 | 9.3 | Comparison |
| 123 | −0.04 | 9.6 | " |
| 124 | −0.06 | 11.6 | Invention |
| 125 | −0.08 | 13.4 | " |
| 126 | −0.02 | 11.7 | " |
| 127 | −0.04 | 13.6 | " |
| 128 | −0.05 | 13.2 | " |

The following conclusion can be drawn from the results of Table 2. Sharpness can be improved (a CTF of 0.5 can be assured at a spatial frequency of not less than 11) by using a water-soluble dye to increase the reflective density to 0.3 or higher. However, where a magenta coupler other than those of the present invention is used, an increase in reflective density (i.e., an increase in amount of the water-soluble dye) is accompanied by an increase in reduction of magenta density due to continuous processing. Such reduction in magenta density due to continuous processing can be minimized by the use of the magenta coupler represented by formula (M-I) according to the present invention. This effect of the magenta coupler of the present invention is significantly enhanced when it is combined with the water-soluble dye represented by formula (IX).

EXAMPLE 2

Light-sensitive materials 201 to 228 were prepared and evaluated in the same manner as for light-sensitive materials 101 to 128 of Example 1, except that the following yellow dyes and cyan dyes were used in combination. The results obtained were similar to those obtained in Example 1, revealing remarkable effects of the present invention.

Yellow Dye:

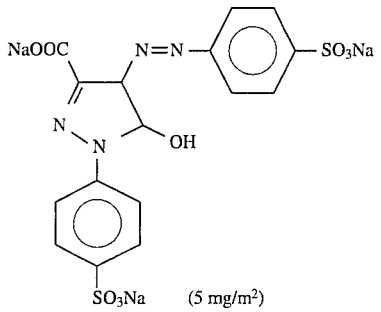

and Dye 1 of the present invention (5 mg/m$^2$)

Cyan Dye:

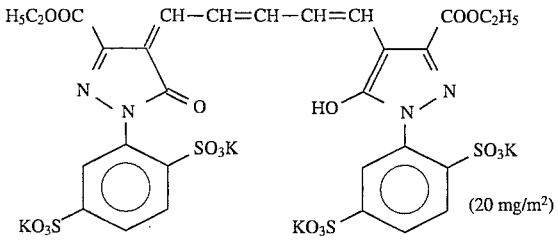

and

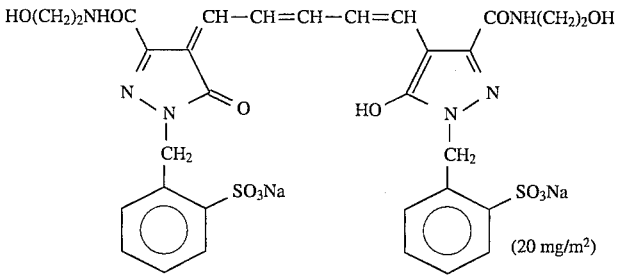

and Dye 38 of the present invention (20 mg/m$^2$).

EXAMPLE 3

Light-sensitive materials prepared in Examples 1 and 2 were evaluated in the same manner as in Example 1, except that exposure was carried out as follows. The results obtained were similar to those obtained in Examples 1 and 2.

Exposure (1) Laser light having a wavelength of 473 nm which was obtained from a YAG solid laser (oscillation wavelength: nm) using a semiconductor laser GaAlAs (oscillation wavelength: 808.5 nm) as an exciting light source by wavelength conversion through an SHG crystal of $KNbO_3$, (2) laser light having a wavelength of 532 nm which was obtained from a $YVO_4$ solid laser (oscillation wavelength: 1064 nm) using a semiconductor laser GaA1As (oscillation wavelength: 808.7 nm) as an exciting light source by wavelength conversion through an SHG crystal of KTP, or (3) laser light of an AlGaInP laser (oscillation wavelength: about 670 nm; Type No. TOLD9211 manufactured by Toshiba Corporation) was used as a light source of laser scanning exposure system. The color paper was moved in the direction vertical to the scanning direction by means of a rotating polyhedron and successively exposed to a laser beam by means of an aligner with a varied quantity of light. The relationship between the density (D) of the light-sensitive material and the exposure (E), D-logE, was obtained, and gradation exposure was conducted on the basis of the relationship. The quantity of laser light having a wavelength of 473 nm or 532 nm was varied by using an outer modulator to control the exposure, and that of laser light having a wavelength of 670 nm was controlled by varying both the quantity of emitted light and the time of emission. The scanning exposure was conducted at a pixel density of 400 dpi and an average exposure time per pixel was about $5\times10^{-8}$ second. The temperature of the semiconductor lasers used was maintained constant by means of a Peltier element in order to suppress variations of quantity of light with temperature.

EXAMPLE 4

The light-sensitive materials prepared in Examples 1 and 2 were exposed in the same manner as in Example 1, processed in the same manner as in Example 1 except for using a paper processing machine and using the following processing solutions according to the following schedule, and evaluated in the same manner as in Example 1. The results obtained were similar to those obtained in Examples 1 and 2, proving that the light-sensitive materials according to the present invention have excellent sharpness and undergo reduced change in magenta density in continuous processing.

| Processing Step | Temp. (°C.) | Time (sec) | Volume of Tank (l) |
|---|---|---|---|
| Color development | 40 | 15 | 2 |
| Bleach-fix | 40 | 15 | 2 |
| Rinsing (1) | 40 | 3 | 1 |
| Rinsing (2) | 40 | 3 | 1 |
| Rinsing (3) | 40 | 3 | 1 |
| Rinsing (4) | 40 | 3 | 1 |
| Rinsing (5) | 40 | 6 | 1 |
| Drying | 70–80 | 15 | |

The water from rinsing (5) was forwarded under pressure to a reverse osmosis membrane, and water having permeated through the membrane was fed to rinsing (5) while the concentrate was returned to rinsing (4). In order to shorten the cross-over time between every two rinsing steps, slits with blades were made on walls of the rinsing bath, through which the light-sensitive material was passed.

Each processing solution had the following formulation.

Color Developer:

-continued

| Rate of Replenishment: | |
|---|---|
| First replenisher | 21 ml/m$^2$ |
| Second replenisher | 14 ml/m$^2$ |
| Total: | 35 ml/m$^2$ |

Rinsing Solution:

| | Running Solution | Replenisher |
|---|---|---|
| Water | 700 ml | 700 ml |
| Ethylenediaminetetraacetic acid | 1.5 g | 3.75 g |
| Disodium 1,2-dihydroxybenzene-4,6-disulfonate | 0.25 g | 0.7 g |
| Triethanolamine | 5.8 g | 14.5 g |
| Potassium chloride | 10.0 g | — |
| Potassium bromide | 0.03 g | — |
| Potassium carbonate | 18.0 g | 24.0 g |
| Fluorescent brightening agent(UVX) (4,4'-diaminostilbene compound) | 1.5 g | 4.5 g |

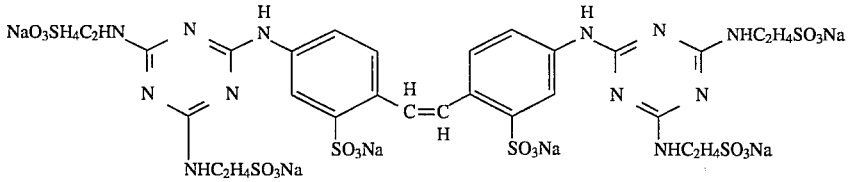

| | | |
|---|---|---|
| Sodium sulfite | 0.1 g | 0.1 g |
| Disodium N,N-bis(sulfonato-ethyl)hydroxylamine | 14.8 g | 29.6 g |
| 4-Amino-3-methyl-N-ethyl-N-(4-hydroxybutyl)aniline 2-p-toluenesulfonate | 9.8 g | 29.3 g |
| Water to make | 1000 ml | 1000 ml |
| pH (25° C.) | 10.05 | 11.60 |

Bleach-Fixing Solution:

Components were divided into two replenishers.

| [First Replenisher] | |
|---|---|
| Water | 150 ml |
| Ethylenebisguanidine nitrate | 30 g |
| Ammonium sulfite monohydrate | 190 g |
| Ethylenediaminetetraacetic acid | 7.5 g |
| Ammonium bromide | 30 g |
| Ammonium thiosulfate (700 g/l) | 340 ml |
| Acetic acid (50%) | 250 ml |
| Water to make | 1000 ml |
| pH (25° C.) | 4.8 |
| [Second Replenisher] | |
| Water | 140 ml |
| Ethylenediaminetetraacetic acid | 11.0 g |
| Ammonium (ethylenediaminetetraacetato)-iron (III) | 715 g |
| Acetic acid (50%) | 100 ml |
| Water to make | 1000 ml |
| pH (25° C.) | 2.0 |

Running Solution of Bleach-Fixing Bath:

| | |
|---|---|
| First replenisher | 300 ml |
| Second replenisher | 200 ml |
| Water to make | 1000 ml |
| pH (25° C.) | 5.0 |

Ion-exchanged water having calcium and magnesium ion concentration each reduced to 3 ppm or less was used as both a running solution and a replenisher.

As described and demonstrated above, the present invention provides a silver halide color light-sensitive material exhibiting excellent color image sharpness and reduced dependence on processing.

While the invention has been described in detail and with reference to specific examples thereof, it will be apparent to one skilled in the art that various changes and modifications can be made therein without departing from the spirit and scope thereof.

What is claimed is:

1. A silver halide color light-sensitive material comprising a reflective support having provided thereon at least three silver halide emulsion layers having different color sensitivity containing a yellow coupler, a magenta coupler or a cyan coupler, respectively, wherein said magenta coupler-containing silver halide emulsion layer contains at least one dye-forming coupler represented by formula (M-I):

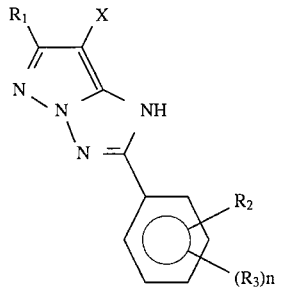

(M-I)

wherein $R_1$ represents a group represented by formula (Q-1):

$$—C(R_4)(R_5)—R_6 \quad \text{(Q-1)}$$

wherein $R_4$ represents an alkyl group or an aryl group; and $R_5$ and $R_6$ each represent a substituent; or $R_4$, $R_5$ and $R_6$ are taken together to form a [5] 3- to 7-membered monocyclic or condensed ring;

a group represented by formula (Q-2):

$$—CH(R_7)—R_8 \quad \text{(Q-2)}$$

wherein $R_7$ represents a secondary or tertiary alkyl group, a cycloalkyl group, an aryl group or a heterocyclic group; $R_8$ represents an alkyl group, a cycloalkyl group, an aryl group or a heterocyclic group; or $R_7$ and $R_8$ are taken together to form a [5] 3- to 7-membered ring;

or a group represented by formula (Q-3):

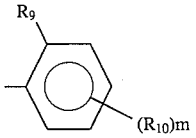

(Q-3)

wherein $R_9$ and $R_{10}$ each represent a substituent; and m represents an integer of 0 to 4; when m is 2 or greater, the plural $R_{10}$ groups may be the same or different;

$R_2$ and $R_3$ each represent a substituent; n represents integer of 0 to 4; when n is 2 or greater, the plural $R_3$ groups may be the same or different; and X represents a hydrogen atom or a group releasable on coupling reaction with an oxidation product of a developing agent, and said light-sensitive material contains at least one hydrophilic layer which contains a water-soluble dye represented by formula (IX):

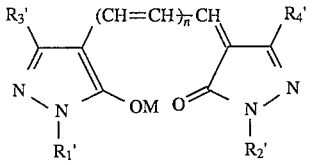

(IX)

wherein $R'_1$, $R'_2$, $R'_3$, and $R'_4$ each represent a hydrogen atom or a substituent, provided that at least one of the total atomic weight of $R'_1$ and $R'_3$ and the total atomic weight of $R'_2$ and $R'_4$ is not more than 160; n represents 0, 1 or 2; and M represents a hydrogen atom or an alkali metal;

said light-sensitive material having a reflection density of not less than 0.3 at 550 nm.

2. A silver halide color light-sensitive material as claimed in claim 1, which has a reflection density of not less than 0.5 at 550 nm.

3. A silver halide color light-sensitive material as claimed in claim 1, wherein $R'_1$, $R'_2$, $R'_3$, and $R'_4$ in formula (IX) each represent a hydrogen atom, an alkyl group, $—COOR'_5$, $—CONR'_6R'_7$, $—CONHR'_8$, $—NR'_9COR'_{10}$, $—NR'_{11}R'_{12}$, —CN, $—OR'_{13}$ or $—NR'_{14}CONR'_{15}R'_{16}$, wherein $R'_5$, $R'_6$, $R'_7$, $R'_8$, $R'_9$, $R'_{10}$, $R'_{11}$, $R'_{12}$, $R'_{13}$, $R'_{14}$, $R'_{15}$, and $R'_{16}$ each represent a hydrogen atom or a substituted or unsubstituted alkyl group; $R'_6$ and $R'_7$, $R'_{11}$ and $R'_{12}$, or $R'_{15}$ and $R'_{16}$ may be taken together to form a ring.

4. A silver halide color light-sensitive material as claimed in claim 1, wherein said water-soluble dye is a compound represented by formula (X):

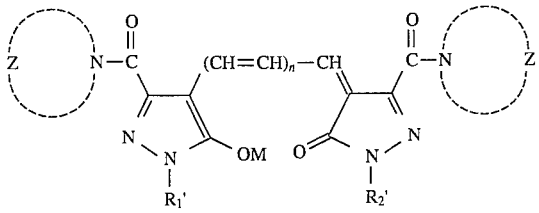

(X)

wherein $R'_1$ and $R'_2$ each represent a hydrogen atom or a substituent; n represents 0, 1 or 2; M represents a hydrogen atom or an alkali metal; Z represents an atomic group necessary to form a 5- or 6-membered saturated heterocyclic group together with the nitrogen atom; provided that at least one of the total atomic weight of $R'_1$ and Z and the total atomic weight of $R'_2$ and Z is not more than 120.

5. A sliver halide color light-sensitive material as claimed in claim 4, wherein $R'_1$, $R'_2$ and Z in formula (X) each have no dissociation group.

6. A silver halide color light-sensitive material as claimed in claim 1, wherein $R'_1$, $R'_2$, $R'_3$, and $R'_4$ in formula (IX) each have no dissociation group.

7. A silver halide color light-sensitive material as claimed in claim 1, wherein said dye-forming coupler represented by formula (M-I) is a compound represented by formula (M-II):

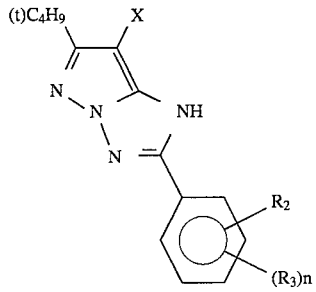

(M-II)

wherein $R_2$, $R_3$, n, and X are as defined in claim 1.

8. A silver halide color light-sensitive material as claimed in claim 1, wherein said dye-forming coupler represented by formula (M-I) is a compound represented by formula (M-III):

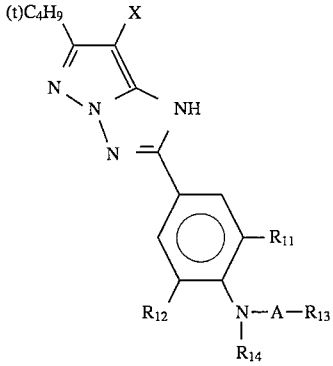

(M-III)

wherein $R_{11}$ and $R_{12}$ each represent a hydrogen atom or a substituent; A represents —CO— or $—SO_2—$; $R_{13}$ represents an alkyl group, an aryl group, an alkoxy group, an alkylamino group or an anilino group; $R_{14}$ represents a hydrogen atom, an alkyl group, an aryl group, an acyl group, an alkanesulfonyl group or an arenesulfonyl group; X represents a hydrogen atom or a group releasable on coupling reaction with an oxidation product of a developing agent; and $R_{13}$ and $R_{14}$ may be taken together to form a 5- to 7-membered ring.

9. A silver halide color light-sensitive material as claimed in claim 1, wherein at least one of said silver halide emulsion layers contains a silver halide emulsion comprising silver chloride, silver chlorobromide or silver chloroiodobromide grains having a silver chloride content of 95 mol % or more and a silver iodide content of not more than 1 mol %.

10. A silver halide color light-sensitive material as claimed in claim 1, wherein said dye-forming coupler represented by formula (M-I) is used in an amount of 0.1 to 1 mol per mol of silver halide of the layer where it is used.

11. A silver halide color light-sensitive material as claimed in claim 1, wherein said water-soluble dye represented by formula (IX) is used in an amount of 0.1 to 200 $mg/m^2$.

12. A silver halide color light-sensitive material as claimed in claim 1, wherein $R_4$, $R_5$ and $R_6$ in (Q-1) can be taken together to form

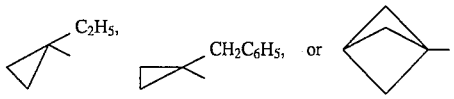

or a 5- to 7-membered ring.

13. A silver halide color light-sensitive material as claimed in claim 1, wherein $R_7$ and $R_8$ in (Q-2) can be taken together to form

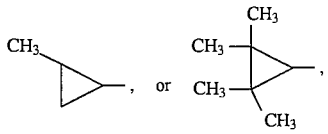

or a 5- to 7-membered ring.

* * * * *